US005250746A

United States Patent [19]

Saito et al.

[11] Patent Number: 5,250,746

[45] Date of Patent: Oct. 5, 1993

[54] CHORD DETECTING APPARATUS

[75] Inventors: Tsutomu Saito, Shizuoka; Taichi Kosugi, Hamamatsu, both of Japan

[73] Assignee: Kabushiki Kaisha Kawai Gakki Seisakusho, Hamamatshu, Japan

[21] Appl. No.: 866,374

[22] Filed: Apr. 9, 1992

[30] Foreign Application Priority Data

Apr. 9, 1991 [JP] Japan ..... 3-103367
Apr. 16, 1991 [JP] Japan ..... 3-109679

[51] Int. Cl.[5] ..... G10H 1/06; G10H 1/38; G10H 7/00

[52] U.S. Cl. ..... 84/613; 84/637; 84/DIG. 22

[58] Field of Search ..... 84/613, 637, DIG. 22

[56] References Cited

U.S. PATENT DOCUMENTS 4,228,712 10/1980 Vehiyama et al. .
4,254,682 3/1981 Machanian et al. ..... 84/DIG. 22 X
4,295,402 10/1981 Deutsch et al. ..... 84/DIG. 22 X
4,450,742 5/1984 Sugiura ..... 84/DIG. 22 X
4,920,849 5/1990 Mizuno ..... 84/613
5,003,860 4/1991 Minamitaka ..... 84/613 X
5,153,361 10/1992 Kozuki ..... 84/613
5,160,797 11/1992 Kim ..... 84/613
5,179,241 1/1993 Okuda et al. ..... 84/613

*Primary Examiner*—William M. Shoop, Jr.
*Assistant Examiner*—Jeffrey W. Donels
*Attorney, Agent, or Firm*—Joseph C. Mason, Jr.; Ronald E. Smith; Kaoru Kawanami

[57] ABSTRACT

Disclosed are a chord detecting/storing apparatus and an accompaniment information processing apparatus. The chord detecting/storing apparatus designates tones consisting of a chord on a keyboard, and extracts one of the designated notes. Based on the extracted note, the apparatus prepares a row of note bits excluding at least one note. Using this note bit row as an address, the apparatus searches for a chord table in advance where chord information is stored to correspond to each pattern for a row of note bits, and reads out searched chord information to detect a chord.

The accompaniment information processing apparatus detects component tones of a chord when the chord is designated from the keyboard, and generates chord information. The accompaniment information processing apparatus produces specific tone information in association with the generated chord information and correlates the specific tone information with the chord information before storing both information items.

16 Claims, 15 Drawing Sheets

| 11 | 10 | 9 | 8 | 7 | 6 | 5 | 4 | 3 | 2 | 1 | 0 |
|---|---|---|---|---|---|---|---|---|---|---|---|
| B | A# | A | G# | G | F# | F | E | D# | D | C# | C |

*Fig. 4*

DATA FORMAT ONLY BY CHORD TONES

| 7 | 6 | 5 | 4 | 3 | 2 | 1 | 0 |
|---|---|---|---|---|---|---|---|
| MINB | | TIMB | | | | | |

| 7 | 6 | 5 | 4 | 3 | 2 | 1 | 0 |
|---|---|---|---|---|---|---|---|
| 0 | CODB | | | ROTB | | | |

*Fig. 5A*

DATA FORMAT IN A DIFFERENT PATTERN
FROM CHORD OR WITH A CHANGE OF OCT

| 7 | 6 | 5 | 4 | 3 | 2 | 1 | 0 |
|---|---|---|---|---|---|---|---|
| OCTB | | TIMB | | | | | |

| 7 | 6 | 5 | 4 | 3 | 2 | 1 | 0 |
|---|---|---|---|---|---|---|---|
| 1 | POSB | | ON/OFF | NOTB | | | |

*Fig. 5B*

| | | | | | | | | | | | |
|---|---|---|---|---|---|---|---|---|---|---|---|
| BITH | 1 | 2 | 3 | 4 | 5 | 6 | 7 | 8 | 9 | 10 | 11 |
| BITL | 11 | 10 | 9 | 8 | 7 | 6 | 5 | 4 | 3 | 2 | 1 |

DATA FORMAT ONLY BY CHORD TONES

DATA FORMAT IN A DIFFERENT PATTERN
FROM CHORD OR WITH A CHANGE OF OCT

CHORD DETECTING APPARATUS

BACKGROUND OF THE INVENTION

1. Field of the Invention

The present invention relates to a chord detecting/storing apparatus and an accompaniment information processing apparatus to be used in, for example, an electronic musical instrument. More particularly, the present invention pertains to a chord detecting/storing apparatus which has a smaller chord table for chord detection and can quickly detect a chord, and an accompaniment information processing apparatus to detect a tone selected on a keyboard, etc, and to store that tone as accompaniment information after it has received predetermined processing.

2. Description of the Related Art

A chord detecting/storing apparatus to be used in an electronic musical instrument or the like is disclosed in, for example, Japanese Patent Examined Publication No. 56-51630 as prior art. To acquire (detect) chord information, this prior art apparatus has a chord table where only a chord type with "C" as a chord root is stored, sequentially compares note bit information produced by depressing a key with the chord table, and repeats a rotational shift until the bit information matches that in the chord table.

This chord detecting/storing apparatus does not need a large chord table; however, it has many processes difficult for a current central processing unit (CPU), such as sequential comparison and rotational shift, and requires much time for chord detection.

Another chord detecting/storing apparatus is disclosed in Japanese Patent Examined Publication No. 62-27717. This apparatus has a chord table which stores all chord patterns, with note "C" being ON. The apparatus detects a chord by rotationally shifting note bit information produced by depressing a key until an ON bit appears at the note "C," and sequentially compares the information with the chord pattern.

According to this invention, processing time is reduced since only one rotational shift is required. The apparatus in this invention, however, though performing a rotational shift, uses a chord table having all note bits as addresses, so that a chord table stored in a memory, such as in a ROM, cannot effectively be utilized.

Further, another chord detecting/storing apparatus is disclosed in Japanese Patent Examined Publication No. 62-27717. This apparatus includes a chord table showing all note bit information. The apparatus uses note bit information produced when a key is depressed as an address pointer into the chord table, thus detecting a chord directly.

In this invention, however, an enormous chord table of "$2^{12}$" is necessary.

As an example of an accompaniment information processing apparatus to be used in an electronic musical instrument or the like, an electronic musical instrument with an automatically playing apparatus is disclosed in Japanese Patent Unexamined Publication No. 62-187388. The apparatus in this invention is designed to store the chord type and chord root of a chord only when that chord is established by key depression on a keyboard.

Another example of an automatically playing apparatus as an accompaniment information processing apparatus is disclosed in Japanese Patent Unexamined Publication No. 1-179087. This apparatus is designed to store the chord type and chord root of a chord when it is established, and to store an unspecified number of chord component tones when the chord is not established.

The inventions disclosed in both publications provide a predetermined effect with respect to efficient storage of chord information; however, they have the following shortcomings.

(1) Since only the chord type and chord root of a chord are stored when that chord is established, the lowest note on a keyboard cannot be determined. Nor can it be determined in which octave the chord is produced. In reproducing a chord, therefore, the only possible process is a fixed one of setting a chord root at the lowest note and reproducing that in a specific octave. Thus an accompaniment cannot be accurately reproduced.

(2) Since chord component tones are stored by the note when the chord is unestablished, the amount of information to be stored increases accordingly.

(3) When a chord is unestablished, Major or special information for no chord establishment is stored and reproduced as an accompaniment pattern, providing an accompaniment which is far from real and natural.

(4) Whether a chord is established and the chord, if established, is stored is carefully checked, but a key-ON condition cannot be detected in an accompaniment area to be stored.

SUMMARY OF THE INVENTION

It is therefore a first object of the present invention to provide a chord detecting/storing apparatus which reduces rotate-shift operation and comparison operations difficult for a CPU and thus accelerates a chord detecting process, and which makes programs and chord tables more compact and thereby decreases their memory storage requirements.

It is a second object of the present invention to provide an accompaniment information processing apparatus which adds specific tone information to chord information when a chord is established and stores the information so as to accurately reproduce the recorded content.

It is a third object of the present invention to provide an accompaniment information processing apparatus which can keep the flow of an actual accompaniment even when a chord is unestablished and reduce the amount of information to be stored.

It is a fourth object of the present invention to provide an accompaniment information processing apparatus which can process recorded chord information at high speed and reproduce the recorded content exactly.

To achieve the first object, a first chord detecting/storing apparatus according to the present invention comprises designating means for designating tones that collectively form a chord; note detecting means for detecting notes of the tones designated by the designating means; note extracting means for extracting one of the notes detected by the note detecting means; note bit preparing means for preparing a row of note bits and for detecting at least one note from said row, based on the notes extracted by the note extracting means; and a chord table for storing chord information to correspond to a pattern of the row of note bits prepared by the note bit preparing means; whereby the chord table is searched using the row of note bits prepared by the note bit preparing means, and chord information is read out to detect a chord.

With a chord root as a reference to establish a chord code, the first chord detecting/storing apparatus uses the fact that one portion of a row of note bits has a specific pattern, and refers to a chord table with a row of note bits from which said specific pattern has been detected thereby detecting a chord.

The chord table can therefore become smaller. If a 1-bit specific pattern is present, for example, removing this bit can reduce the size of a chord table by half. If the existing specific pattern is a 2-bit, removing these 2 bits can reduce the chord table size by three quarters. In the same manner, the chord table can be made more compact by a power of "2" depending on the number of bits of a specific pattern Further, to achieve the first object, a second chord detecting/storing apparatus according to the present invention comprises designating means for designating tones that collectively form a chord; note detecting means for detecting notes of the tones designated by the designating means; note bit row dividing means for dividing note information detected by the note detecting means into at least two rows of note bits; a first chord table for storing address information to correspond to patterns of the rows of note bits divided by the note bit row dividing means; and a second chord table for storing chord information to correspond to the patterns acquired from the first chord table, whereby the first chord table for storing the address information is referred to at least once, using a predetermined row of note bits divided and prepared by the note bit row dividing means, and the second chord table for the chord information is searched, using acquired address information and other rows of note bits, so that chord information is read out to detect a chord.

The second chord detecting/storing apparatus divides note information into two or more rows of note bits, and has the first and second chord tables for storing address information and chord information for each row of bit notes. Using one of the divided rows of note bits, this apparatus refers to the first chord table at least one time, and uses address information acquired during that reference and other divided rows of note bits to refer to the second chord table to detect a chord.

This chord detecting/storing apparatus therefore does not have to rotate and shift the rows of note bits, and only needs a memory capacity equal to the total of capacities designatable by the number of bits in each row of note bits. Supposing that a row of 12 note bits is divided into 8 bits and 4 bits, a memory capacity of "$2^{12}=4096$" addresses will actually be necessary. The required memory capacity is however calculated as "$2^8+2^4\times256=256+4096=4352$." Since about half of the patterns present in "$2^8$" cannot serve as a chord, only about half of "$2^4$" is checked. The necessary memory capacity is therefore reduced. As in the above-described case, the chord table size in this case can be minimized.

To achieve the second object, a first accompaniment information processing apparatus according to the present invention comprises designating means for designating a musical tone; component tone detecting means for detecting component tones of the musical tone designated by the designating means; chord information generating means for detecting a chord from the component tones detected by the component tone detecting means to generate chord information; specific tone information generating means for generating specific tone information about the chord information generated by the chord information generating means; and storing means for storing the specific tone information generated by the specific tone information generating means and the chord information generated by the chord information generating means, both the information being correlated to each other.

The first accompaniment information processing apparatus correlates detected chord information with specific tone information relating to the chord information, for example, information about the lowest or highest component tone of a chord and octave information, and stores both information items.

It is therefore possible to develop a chord consisting of the same component tones in reference to the lowest or highest tone of that chord and reproduce a chord in a predetermined variation, or to reproduce a chord in a predetermined compass. A recorded accompaniment can be reproduced exactly.

To achieve the third object, a second accompaniment processing apparatus according to the present invention comprises designating means for designating a musical tone; component tone detecting means for detecting component tones of the musical tone designated by the designating means; chord/compensation information generating means for generating chord information when a chord is judged to be established by the component tones detected by the component tone detecting means, and generating compensation information with respect to chord information or component tone information stored immediately before a chord is judged to be unestablished; and storing means for storing the chord information or the compensation information generated by the chord/compensation information generating means.

The second accompaniment information processing apparatus is provided with the aspect of a characteristic that non-establishment of a chord is mostly caused by extra keys being depressed or released during the process of moving from a predetermined chord to the next chord. When a chord is not detected to be established, therefore, the second accompaniment information processing apparatus stores a change from that chord information stored immediately before as compensation information.

Accordingly, the amount of information to be stored when a chord is unestablished is drastically reduced. Further, when a chord is not established, chord information previously stored is still valuable; that information is at least used, for example, as a chord type. Produced performance therefore sounds natural.

To achieve the fourth object, a third accompaniment information processing apparatus according to the present invention comprises designating means for designating a musical tone; tone bit row preparing means for detecting component tones from tone information designated by the designating means and preparing a row of predetermined tone bits; specific tone information generating means for generating specific tone information relating to a row of the predetermined tone bits prepared by the tone bit row preparing means; and storing means for correlating a row of the predetermined tone bits prepared by the tone bit row preparing means with the specific tone information generated by the specific tone information generating means before storage.

In storing accompaniment information, the third accompaniment information processing apparatus does not store a chord as a chord type and chord root after chord detection. Instead, regardless of chord establishment/non-establishment, this apparatus stores component tones designated by the designating means as a row of predetermined tone bits, for example, a row of 12 tone bits (one octave), together with specific tone information, such as information about the highest or the lowest tone or octave information.

As a result, the process of recording chord information is fast and no extra processing is performed on recorded information, and a more accurate accompaniment is easily reproduced. Since a chord is detected as needed at the reproduction time, stored information can be generally and broadly used according to the purpose of use so as to expand the application range of that information.

BRIEF DESCRIPTION OF THE DRAWINGS

FIG. 4 is a diagram for explaining the format of a BITB register to be used in the chord detecting process according to the first embodiment;

FIGS. 5A and 5B are diagrams for explaining a data format to be used in the chord detecting process according to the first embodiment;

DETAILED DESCRIPTION OF THE PREFERRED EMBODIMENTS

Figure 1:
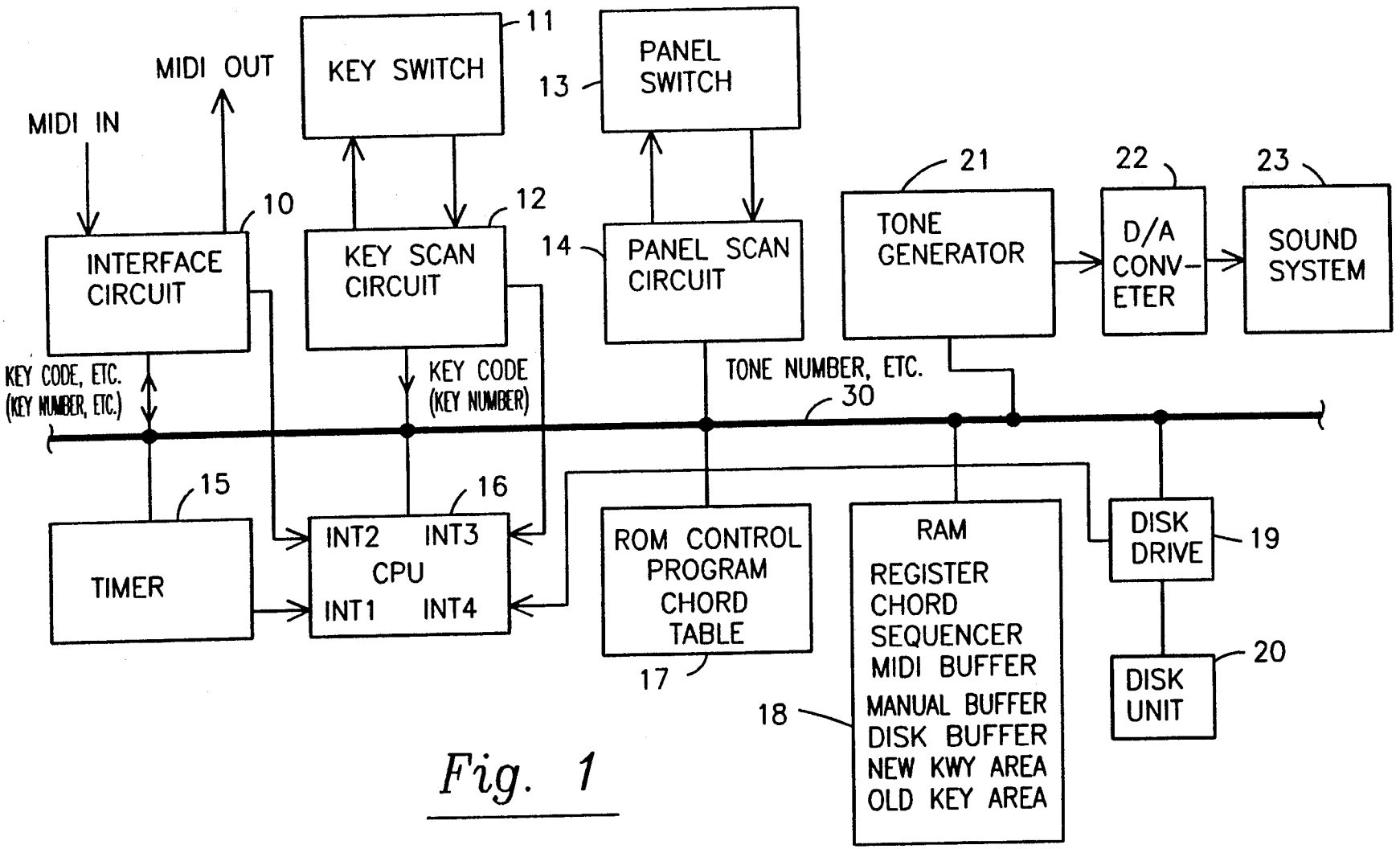
FIG. 1 is a schematic block diagram illustrating the structure of one embodiment of an electronic musical instrument which incorporates a chord detecting/storing apparatus and an accompaniment information processing apparatus according to the present invention.

FIG. 1 is a schematic block diagram illustrating the structure of an electronic musical instrument including a chord detecting/storing apparatus and an accompaniment information processing apparatus according to the present invention.

In FIG. 1, an interface circuit 10 performs a serial input/output. By the interface circuit 10, the electronic musical instrument exchanges MIDI (Musical Instrument Digital Interface) data with an external device.

The interface circuit 10 has a "MIDI IN" terminal and a "MIDI OUT" terminal on the side of the external device. The CPU side of the interface circuit 10 is connected to a system bus 30. The interface circuit 10 exchanges information by a standardized MIDI interface on the side of the external device and by key codes (key numbers) or the like on the CPU side.

The key numbers are numbers assigned to the individual keys on a keyboard according to the MIDI standards. The key numbers are increased by "12" per octave, such as $C_{-1}=0$, $Co=12$, $C_1=24$, $C_2=36$, . . .

The interface circuit 10 outputs an interrupt request signal, which is sent to an interrupt terminal INT2 of a CPU 16. The interface circuit 10 renders this interrupt request signal active to process an interrupt in the CPU 16, requesting that MIDI data should be transferred from the interface circuit 10 to a MIDI buffer in a random access memory (hereafter referred to as "RAM") 18.

Key switches 11 are provided in correspondence with the individual keys on the keyboard, and are turned on/off in accordance with key depression/release. The output of the individual key switch 11 is supplied to a key scan circuit 12.

The key scan circuit 12 detects the ON/OFF status of the individual key switch 11, which is in turn output as a key code (key number) to the system bus 30. The key scan circuit 12 outputs an interrupt request signal, which is then sent to an interrupt terminal INT3 of the CPU 16. The key scan circuit 12 renders this interrupt request signal active to process an interrupt in the CPU 16, requesting that MIDI data should be transferred from the key scan circuit 12 to a manual buffer in the RAM 18.

Panel switches 13 include a timbre switch, a volume switch, a REC switch, a PLY switch and a START switch all provided on a panel (not shown). The output from the each of the panel switches 13 is sent to a panel scan circuit 14.

The panel scan circuit 14 detects the ON/OFF status of each of the panel switches 13, and outputs the detected ON/OFF status as a number corresponding to the individual panel switch 13 (tone number in the case of the timbre switch) to the system bus 30.

A timer 15 is used to control a tempo speed. An arbitrary count value is set at the timer 15 by the CPU 16. The timer 15 generates an interrupt request signal after counting the set count value. The interrupt request signal from the timer 15 is sent to an interrupt terminal INT1 of the CPU 16. The CPU 16 then controls a tempo speed to synchronize that speed with the interval of the interrupt request signal which the timer 15 generates.

The CPU 16 controls the entire system of the electronic musical instrument according to this embodiment, and accomplishes all functions as a chord detecting/storing apparatus and an accompaniment information processing apparatus.

Upon reception of a key number as tone designating information, for example, the CPU 16 drives a tone generator 21 to generate a musical tone according to a currently selected timbre. Further, based on the received key number, the CPU 16 detects chord information or compensation information, executing an automatic accompaniment. The CPU 16 stores and reproduces the detected chord information and compensation information. The processes done by the CPU 16 will be explained in detail later.

A read only memory (hereafter referred to as "ROM") 17 has a control program to operate the CPU 16, and a chord table (to be described in detail later) for detecting a chord, etc. stored therein.

In the RAM 18, a work register of the CPU 16, a storage area for a chord sequencer, the MIDI buffer, the manual buffer, a disk buffer, a new key area, an old key area, etc. are defined. The detailed explanations of these will be explained later.

A disk driver 19 controls a disk unit 20. The disk driver 19 writes playing information on the disk unit 20 as a storing means and reads that information from the disk unit 20 in the same manner as the input/output of the MIDI data. To use the disk unit 20 efficiently, data is to be transferred by the unit of a block (e.g. 256 to 1024 bytes) by a disk buffer provided in the RAM 18.

The disk driver 19 outputs an interrupt request signal, which is sent to an interrupt terminal INT4 of a CPU 16. The disk driver 19 renders this interrupt request signal active to process an interrupt in the CPU 16, requesting the data transfer from the disk unit 20 to the disk buffer in the RAM 18, or vice versa.

The tone generator 21 generates a digital tone signal by time sharing, based on the key numbers and tone numbers for 32 channels assigned by the CPU 16. The digital tone signal generated by the tone generator 21 is supplied to a D/A converter 22.

The D/A converter 22 converts the received digital tone signal into an analog tone signal, which is supplied to a sound system 23.

The sound system 23 converts the analog tone signal as an input electric signal into an acoustic signal. In other words, the sound system 23 is acoustic generating means, such as a loudspeaker or a headphone, to release musical tones.

The interface circuit 10, the key scan circuit 12, the panel scan circuit 14, the timer 15, the CPU 16, the ROM 17, the RAM 18, the disk driver 19 and the tone generator 21 are mutually connected by the system bus 30.

The operation of the thus structured electronic musical instrument will now be described.

Figure 2:
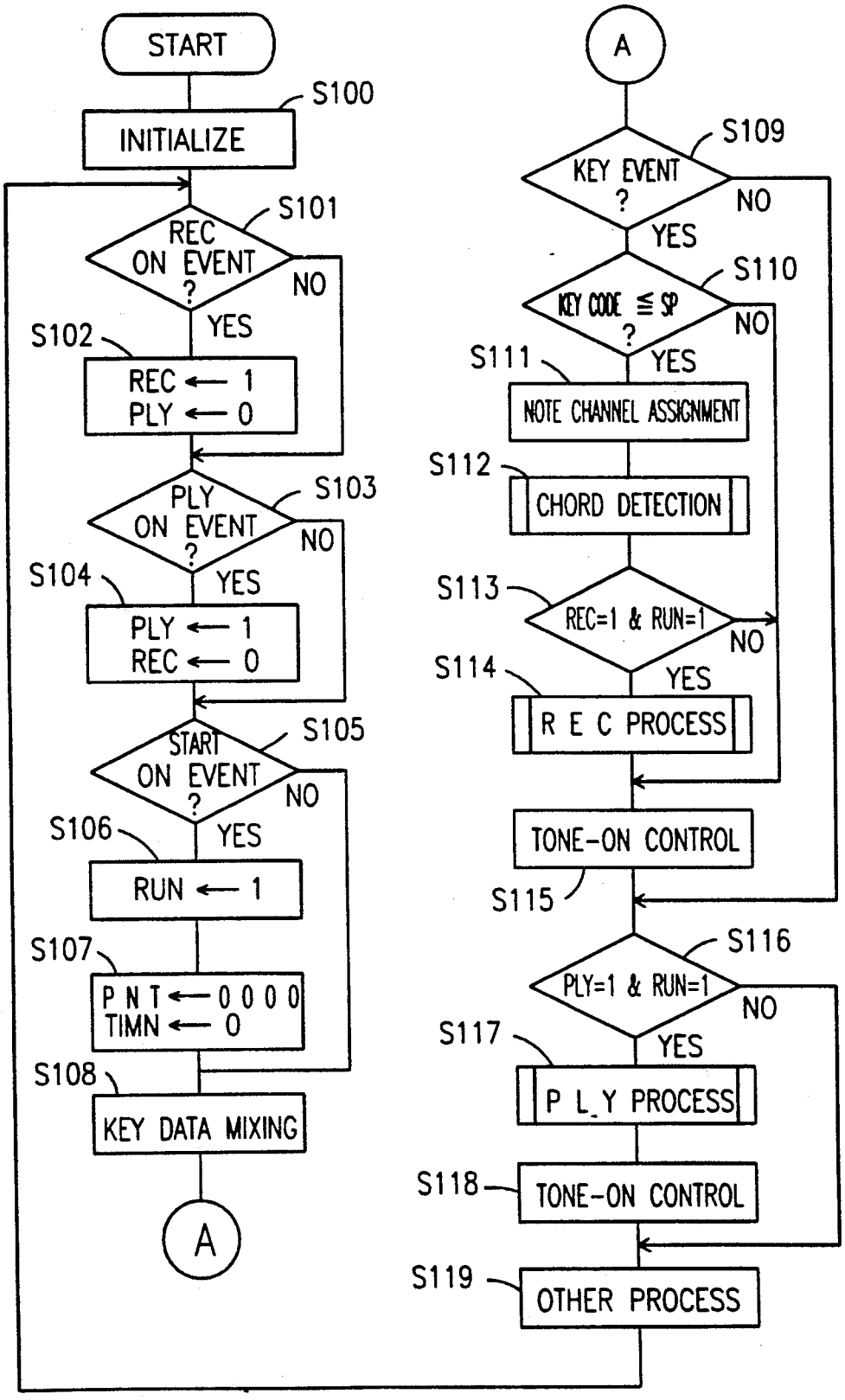
FIG. 2 is the main flowchart showing the main operation of the electronic musical instrument as the chord detecting/storing apparatus and accompaniment information processing apparatus of the present invention.

FIG. 2 shows the main flowchart of the electronic musical instrument as a chord detecting/storing apparatus and an accompaniment information processing apparatus according to embodiments of the present invention.

When power is turned on or resetting is done, initialization is performed (step S100). In this process, individual hardware is initialized or set to an initial value, the content of the RAM 18 is initialized, etc.

It is then checked whether or not the ON event of the REC switch has occurred (step S101). The REC switch is one of the panel switches 13. By the REC switch it is instructed whether or not chord information, detected in a chord detection process to be performed later (step S112), should be stored in the chord sequencer in the RAM 18.

If the ON event of the REC switch is judged in step S101 to have occurred, a REC flag and a PLY flag are set respectively to "1" and "0" (step S102). The REC and PLY flags are defined in a predetermined area in the RAM 18. When the ON event of the REC switch is not judged to have occurred, the process in step S102 is skipped.

It is then checked whether or not the ON event of the PLY switch has occurred (step S103). The PLY switch is also one of the panel switches 13. By the PLY switch it is instructed whether or not chord information, stored in the code sequencer in the RAM 18, should be reproduced in a tempo speed.

If the ON event of the PLY switch is judged in step S103 to have occurred, the PLY flag and the REC flag are set to "1" and "0," respectively (step S104). When the ON event of the PLY switch is not judged to have occurred, the process in step S104 is skipped.

As apparent from the above-described process, the PLY flag and the REC flag are not set to "1" at the same time, so that the storing of detected chord information and reproduction of stored chord information cannot be done at the same time.

It is checked if the ON event of the START switch has occurred (step S105). The START switch is one of the panel switches 13. With the START switch it is instructed whether a process of detecting and storing a chord (REC process) or a process of reproducing stored chord information (PLY process) should be started.

When it is judged in step S105 that the ON-event of the START switch has occurred, a RUN flag is set to "1" (step S106). The RUN flag is a flag defined in a predetermined area in the RAM 18.

A pointer PNT and a timer counter TIMN of the chord sequencer in the RAM 18 are cleared to "0" (step S107). The pointer PNT indicates the position of data in the chord sequencer which is currently being read or recorded. The timer counter TIMN is incremented upon each generation of an interrupt request signal from the timer 15 on condition that the RUN flag is set to "1" or in the RUN state (see FIG. 12A). The pointer PNT and the timer counter TIMN are provided in the RAM 18.

If the ON event of the START switch is not judged to have occurred, the processes in steps S106 and 107 are skipped.

Then, key data mixing is processed (step S108). A logical sum of a MIDI input key number, a manual input key number and a disk reproducing key number is acquired in the key data mixing process. The MIDI input key number, the manual input key number and the disk reproducing key number are stored respectively in the MIDI buffer, the manual buffer and the disk buffer in the RAM 18. Through this mixing process, new key information about key numbers 0 to 127 is prepared in the new key area of the RAM 18.

It is checked whether or not a key event has occurred (step S109). An exclusive-or operation is performed on the contents of the new key area and the old key area in the RAM 18, and it is checked if the result is "0." It is checked at the same time whether or not the key events of the MIDI input key number, the manual input key number and the disk reproducing key number have occurred.

If no key event is judged to have occurred, the process sequence moves to step S116. In other words, where no key event has occurred, a chord detecting process, a REC process, etc. are not performed. If the key event is judged to have occurred, it is checked if the number of a key where the event has occurred is equal to or smaller than the key number of a split point (SP)(step S110).

The split point (SP) is a key number which indicates the border of a keyboard area for chord detection with a keyboard area for normal tone generation. Generally, keys whose numbers are equal to or lower than the key number of the split point belong to a chord area, and are used to detect a chord. Before chord detection, therefore, it is necessary to determine if the key number is greater or smaller than that of the split point. When a chord is to be detected in all the key areas, the split point at this time is set to "127." Normally, the split point is variably set.

When the number of the key where the key event has occurred is judged greater than the key number of the split point in step S110, that key is not a target key for chord detection. The following chord detecting process and the REC process are not performed, and the process sequence goes to step S115 where a tone-ON process by normal key depression is performed.

If the number of the key where the event has occurred is judged equal to or smaller than the key number of the split point (SP), a note channel is assigned (step S111). In this process, extra tone-ON channels for a chord which correspond to 12 particular notes are provided other than normal tone-on channels, and only one tone is generated for the same notes. The note channel assigning is used for automatic accompaniments (auto accompaniment or auto arupejio).

A chord detecting process is then performed (step S112). The details of the chord detecting process will be explained later.

It is checked if "REC=1 and RUN=1" (step S113), i.e., whether or not storing chord information is designated. When the storage of chord information is judged to be designated, a REC process is performed (step S114). That is, the chord information detected in step S112 is sequentially stored in the chord sequencer in the RAM 18. The details of the REC process will be described later. When it is not judged in step S113 that the storage of chord information is designated, the REC process is skipped.

A tone-ON control process is done (step S115). In this tone-ON control process, an upper or lower timbre is selected depending on whether the number of the depressed or released key is greater or smaller than the key number of the split point, thereby generating a musical tone according to the key event. More specifically, with the key-ON event, the key is assigned to a corresponding channel to start tone generation, while with the key-OFF event, a channel corresponding to the key number is searched. Thus tone generation is shifted to tone release.

It is checked if "PLY=1 and RUN=1" (step S116), i.e., whether or not reproduction of chord information is designated. When the reproduction of chord information is judged to be designated, a PLY process is performed (step S117). That is, the chord information stored in the chord sequencer in the RAM 18 is read out and reproduced. The details of the PLY process will be described later.

The PLY process is done in the same manner as in the note channel assigning process in step S111, tone-ON control as in step S115 is performed (step S118).

When it is judged in step S116 that the reproduction of chord information is not designated, the PLY process (step S117) and the tone-ON control process (step S118) are skipped.

"Other processes" are performed (step S119). "Other processes" do not directly relate to the present invention, such as a panel process, a MIDI output process, a disk unit writing process, or other automatic playing process (auto bass process, etc.). Then the flow returns to step S101 and the same processes are repeated.

The automatic playing process is performed referring to contents of a CODO register and an ROTO register both to be described later and the content of the note channel assignment.

Next, the chord detecting process in step S112 of the main routine will be described in detail.

Figure 3A:
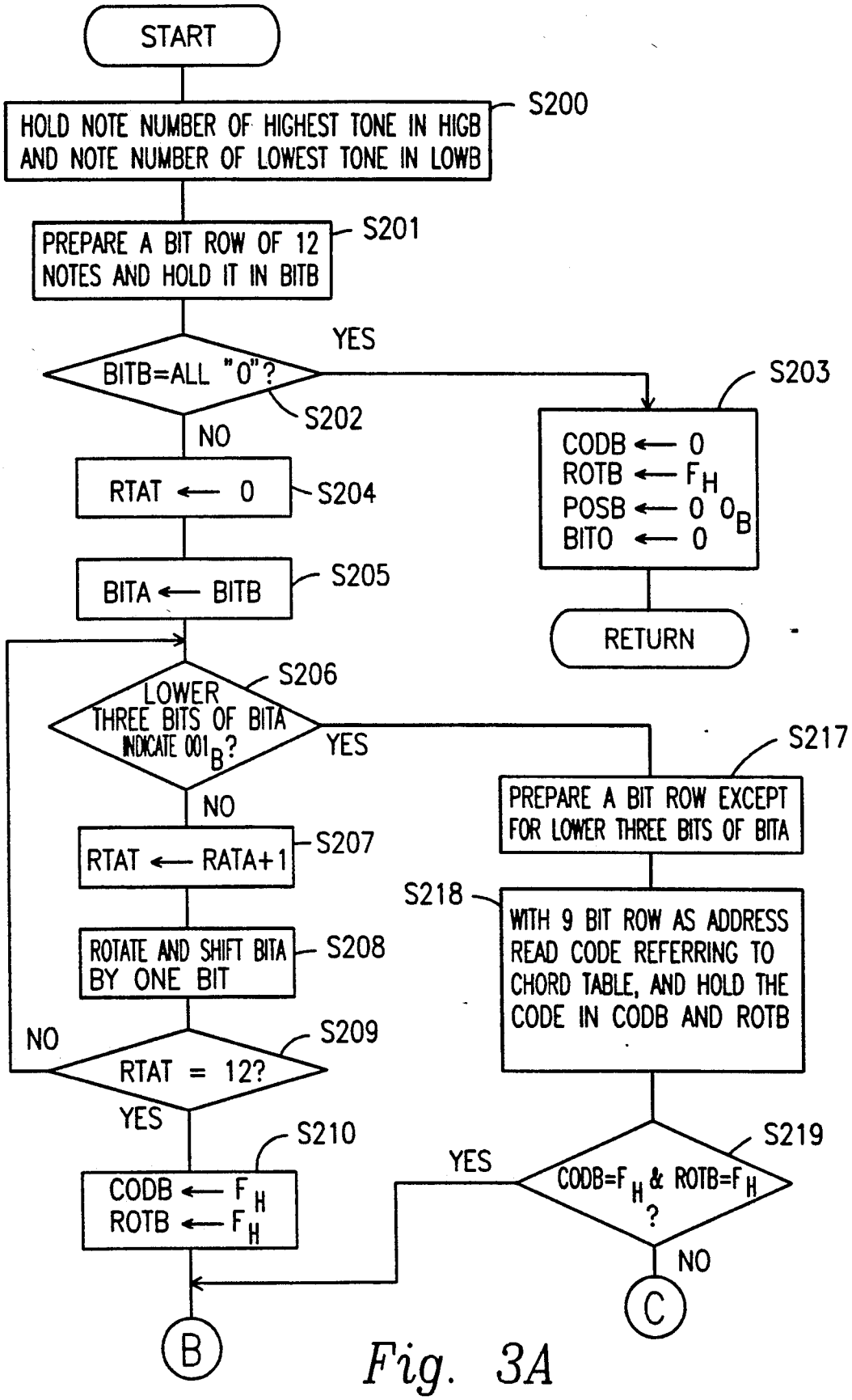
FIGS. 3A and 3B are flowcharts showing a chord detecting process according to a first embodiment.
Figure 3B:
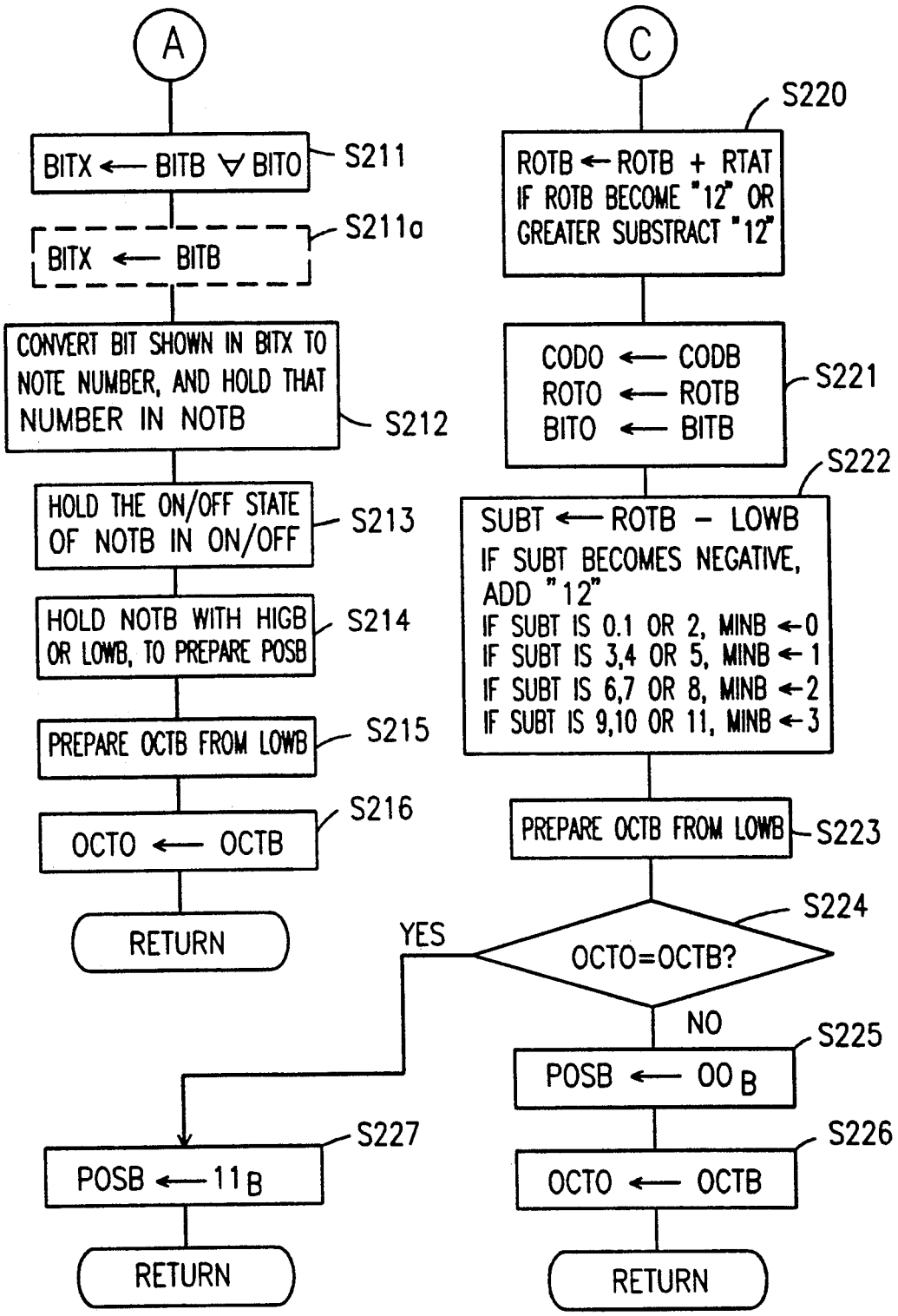

FIGS. 3A and 3B are flowcharts showing the chord detecting process according to the first embodiment.

In this process, first of all, the note number of the highest tone among the keys in the chord area is loaded in an HIGB register and the note number of the lowest tone is loaded in an LOWB register (step S200). The HIGB register and the LOWB register are defined in the RAM 18. Octave numbers are also loaded at the same time in the HIGB register and the LOWB register.

The note numbers in this case are:

$C=0000_B$,
$C\#=0001_B$,
$D=0010_B$,
$D\#=0011_B$,
$E=0100_B$,
$F=0101_B$,
$F\#=0110_B$,
$G=0111_B$,
$G\#=1000_B$,
$A=1001_B$,
$A\#=1010_B$, and
$B=1011_B$. "$_B$" indicates a binary number, and is hereafter used as the binary number.

The octave numbers are:

$B_1$ or below$=00_B$,
$C_2$ to $B_2=01_B$,
$C_3$ to $B_3=10_B$,
$C_4$ or above$=11_B$.

Then the inclusive-or operation is performed on data about the key-ON/key-OFF state in the chord area for every octave, and the result is loaded as a row of bits in a BITB register (step S201). The BITB register is a 12-bit register defined in the RAM 18 as shown in FIG. 4.

It is checked whether or not the contents of the BITB register are all "0," i.e., whether no keys are ON in the chord area (step S202).

When all the contents are judged to be "0," the CODB register and the ROTB register are set respectively to "0" and "$F_H$." ("$_H$" indicates a hexadecimal number. The same shall apply hereinafter.) The POSB register and the BITO register are also set to "$00_B$" and "0," respectively (step S203). The flow returns from the chord detecting process routine.

The CODB register, the ROTB register, the POSB register and the BITO register are defined in the RAM 18.

The CODB register serves as a register for storing chord types. There are seven chord types as shown in the right side of Table 1, which are represented by chord values "0" to "7." Loading "0" to the CODB register means that there is no key rendered ON in the chord area.

TABLE 1

| | | Chord establishment in case of "C" as a root | | | | | | | | | | |
|---|---|---|---|---|---|---|---|---|---|---|---|---|
| B | A# | A | G# | G | F# | F | E | D# | D | C# | C | Chord type (number) |
| 0 | 0 | 0 | 0 | 0 | 0 | 0 | 0 | 0 | 0 | 0 | 0 | OFF (0) |
| 0 | 0 | 0 | 0 | 1 | 0 | 0 | 1 | 0 | 0 | 0 | 1 | Major (1) |
| 0 | 0 | 0 | 0 | 1 | 0 | 0 | 0 | 1 | 0 | 0 | 1 | minor (2) |
| 0 | 1 | 0 | 0 | 1 | 0 | 0 | 1 | 0 | 0 | 0 | 1 | 7th (3) |
| 0 | 1 | 0 | 0 | 0 | 0 | 0 | 0 | 1 | 0 | 0 | 1 | minor7th (4) |
| 0 | 0 | 0 | 0 | 1 | 0 | 1 | 0 | 0 | 0 | 0 | 1 | sus4 (5) |
| 0 | 0 | 1 | 0 | 0 | 1 | 0 | 0 | 1 | 0 | 0 | 1 | Diminish (6) |
| 0 | 0 | 0 | 1 | 0 | 0 | 0 | 1 | 0 | 0 | 0 | 1 | Augment (7) |

The ROTB register stores a chord root. The chord root is represented by the same chord as the note number. There are 12 types of chord roots, $C=0000_B$, $C\#=0001_B$, $D=0010_B$, . . . , and $B=1011_B$. To store "$F_H$" in the ROTB register means there is no corresponding chord root.

The POSB register is a register to store a compensation tone. To store "$00_B$" in the POSB register means that no compensation tones (to be described later) exist.

The BITO register is a register for storing a row of bits acquired through the current chord detecting process, i.e., the content of the BITB, and is referred to in the next chord detecting process.

If it is judged in step S202 that the contents of the BITB register are not all "0," or that a key in the chord area is ON, an RTAT register is cleared (step S204). The RTAT register is a register defined by the RAM 18 for storing the number of rotational shifts of a row of bits.

The content of the BITB register is stored in the BITA register (step S205). The BITA register is a work register defined in the RAM 18 for rotationally shifting a row of bits.

It is then checked whether or not the lower three bits in the BITA register are "$001_B$" (step S206). This is because as shown in Table 1 the lower three bits are noticed to be "$001_B$" when a chord is established. It has been checked in step S202 that the lower three bits are all "0," and this case is already excluded.

When the lower three bits of the BITA register are not judged as "$001_B$" in step S206, the content of the RTAT register is incremented (step S207), and then the BITA register is rotationally shifted by one bit (step S208). This rotational shifting direction can be either rightward or leftward.

It is checked if the content of the RTAT register is "12," i.e., the BITA register is rotationally shifted by 12 times (rotates one round)(step S209). If the content of the RTAT register is not "12," the flow returns to step S206 and the processes in steps S206 to S209 are repeated.

When the content of the RTAT register is judged as "12" in step S209 after the processes are repeated, a chord is judged to be not established, and the following processes from step S210 for no chord establishment are performed.

First, "$F_H$" is held in both the CODB register and the ROTB register (step S210). "$F_H$" as the content of the CODB register means that a chord is not established though there is a key set ON in the chord area.

The exclusive-or operation (indicated by a symbol in FIG. 3B) is performed on the content of the BITB register and that of the BITO register where a row of bits acquired through the previous chord detecting process is held. The result is stored in a BITX register (step S211). The BITX register is a register defined in the RAM 18, and stores bits in the current row which are changed from those in the previous row. In the exclusive-or operation, the changed bits are stored as "1" in the BITX register.

The process in step S211*a* is then performed, but this step can be skipped. If this process is skipped, the content of the BITO register has no change when no chord is established, and information to be stored in the memory is always a change bit with respect to the code of a chord which is established before (including a code when all keys are released). What chord is used as a current base is therefore apparent.

If the process in step S211*a* is not skipped, the content of the BITO register is changed regardless of chord establishment/non-establishment, and information to be stored in the memory is always only a change bit with respect to a row of bits which is present immediately before the flow enters this routine. It is therefore possible to keep the amount of stored information at the lowest level.

Data is prepared in a format shown in FIG. 5B. The registers where the data is stored are defined in the RAM 18.

A bit of "1" in the BITX register is converted into a note number which is stored in an NOTB register for storing a note number (step S212).

It is determined referring to the BITB register whether the bit "1" in the BITX register has newly been set ON or OFF at this time, and the result is stored in an ON/OFF register (step S213).

Then, the NOTB register is compared with the HIGB register and the LOWB register to produce a compensation tone, which is in turn stored in the POSB register (step S214). In other words, it is checked if the content of the NOTB register is the same as the contents of the HIGB register and the LOWB register, and 2-bit data is prepared on the following condition and stored in the POSB register.

(1) If NOTB=HIGB, $POSB=10_B$ (highest tone)
(2) If NOTB=LOWB, $POSB=01_B$ (lowest tone)
(3) If NOTB is neither, $POSB=11_B$ (middle tone).
If there is no compensation note, $POSB=00_B$.

An octave number is fetched from the LOWB register, and is stored in an OCTB register (step S215). The content of the OCTB register is then held in an OCTO register (step S216). The OCTO register is a register defined in the RAM 18 to store an octave number acquired in the previous chord detecting process. After the process in step S216 is completed, the flow returns from the chord detecting process routine. The process in case where a chord is not established is terminated.

If it is judged in step S206 that the lower three bits of the BITA register are "$001_B$", data in a format shown in FIG. 5A is prepared.

More specifically, a row of bits is prepared which consists of nine bits excluding the lower three bits of the BITA register (step S217). If the content of the BITA register is, for example,

BITA="0 0 0 0 1 0 0 1 0 0 0 1",

Bit row="0 0 0 0 1 0 0 1 0" is prepared as a row of nine bits.

Next, a chord type and a sub chord root are read at addresses corresponding to the row of bits as an address, referring to a chord table, such as Table 2, and are stored in the CODB register and ROTB register, respectively (step S218).

TABLE 2

Chord table used in a chord detecting process according to the first embodiment

| Address | | | | | | | | | Contents | |
|---|---|---|---|---|---|---|---|---|---|---|
| | | | | | | | | | 7 6 5 4 | 3 2 1 0 |
| $b_8$ | $b_7$ | $b_6$ | $b_5$ | $b_4$ | $b_3$ | $b_2$ | $b_1$ | $b_0$ | Chord type | Sub chord root |
| 0 | 0 | 0 | 0 | 0 | 0 | 0 | 0 | 0 | F (unestablished) | F (unestablished) |
| 0 | 0 | 0 | 0 | 0 | 0 | 0 | 0 | 1 | F (unestablished) | F (unestablished) |
| 0 | ∫ 0 | 0 | 0 | ∫ 1 | 0 | 0 | ∫ 1 | 0 | ∫ 0 (Major) | ∫ 0 (C) |
| 0 | ∫ 0 | 0 | 1 | ∫ 0 | 0 | 0 | ∫ 0 | 1 | ∫ 0 (Major) | ∫ 4 (E) |
| 0 | ∫ 1 | 0 | 0 | ∫ 0 | 0 | 0 | ∫ 0 | 1 | ∫ 4 (minor7th) | ∫ 0 (C) |
| 1 | ∫ 1 | 1 | 1 | ∫ 1 | 1 | 1 | ∫ 1 | 1 | ∫ F (unestablished) | ∫ F (unestablished) |

"$FF_H$" is acquired when a chord is not established, while chord types 0 to 7 and sub chord roots 0 to $B_H$ are obtained when a chord is established. Therefore, the chord type indicated by the upper four bits is held in the CODB register and the sub chord root indicated by the lower four bits is held in the ROTB register.

It is then checked whether or not the contents of the CODB register and the ROTB register are both "$F_H$" step S219), i.e., if a chord is not established.

When the contents of both registers are judged as "$FF_H$, " it is acknowledged that a chord is not established, and the flow branches to step S211. The subsequent processes from step S211 are already described above, and their explanation will not be given.

When it is judged in step S219 that the content of the CODB register or that of the ROTB register is not "$F_H$," the sub chord root of the ROTB register acquired referring to Table 2 is added to the content of the RTAT register which stores the number of previous rotational shiftings, and the result is stored in the ROTB register (step S220). If the result is greater than "12," however, "12" is subtracted. Accordingly, a real chord root (correct chord root) is yielded in the ROTB register.

The contents of the CODB register, the ROTB register, and the BITB register are respectively stored in the CODO register, the ROTO register and the BITO register (step S221).

Then, a process is performed to represent the note of the lowest tone from the keys ON in the chord area by the small number of bits (two bits)(step S222).

That is, it is checked from Table 1 how far from the correct chord root (stored in the ROTB register) the note of the lowest tone (stored in the LOWB register) is positioned.

In fact, the content of the LOWB register is subtracted from the content of the ROTB register. If the result is "12" or greater, "12" is subtracted, and if the result is a negative value, "12" is added. The resultant value is then stored in an SUBT register. The values stored in the SUBT register "0" to "11" are classified as follows, and are stored in an MINB register.

(1) If the content of the SUBT register is 0, 1 or 2, the MINB register←$00_B$.

(2) If the content of the SUBT register is 3, 4 or 5, the MINB register←$01_B$.

(3) If the content of the SUBT register is 6, 7 or 8, the MINB register←$10_B$.

(4) If the content of the SUBT register is 9, 10 or 11, the MINB register←$11_B$.

It is apparent from Table 1 to utilize a characteristic that, when the content of the SUBT register is divided into four blocks each having three tones, each block has only one key ON.

To more consistently obtain a value to be stored in the MINB register, keys in the ON state may be counted by the chord root to use the counted number when it is equal to the note number in the LOWB register.

The octave number stored in the LOWB register is held in the OCTB register (step S223).

By comparing the content of the OCTO register with that of the OCTB register, it is checked if a currently obtained octave number is changed from the octave number acquired through the previous chord detecting routine (step S224).

When the octave number is judged to be unchanged, the flow branches to step S227 where the content of the POSB register is set to "$11_B$" indicating no octave change. The flow then returns from the chord detecting process. In this case, the value of the POSB register particularly indicates no octave change, though it usually indicates a middle tone.

If the octave number is judged to be changed, the content of the POSB register is set to "$00_B$" (step S225). This indicates that the octave is altered but no compensation note is present.

The content of the OCTB register is stored in the OCTO register (step S226), and then the flow returns from the chord detecting routine.

In the above-described chord detecting process according to the first embodiment, a bit row pattern has been checked with regard to the lower three bits of a bit row, but a bit row pattern may be checked, for example, with regard to the upper three bits, or other arbitrary three bits.

The number of bits to be checked as a bit pattern is not limited to three bits. For example, the lower two bits are set to "$01_B$," the other ten bits are regarded as addresses when the same bit pattern is found out. In these conditions, referring to a chord table constituted by addresses having one bit more than those in Table 2, it can be checked whether or not a chord is established.

It is also possible to detect the state "1" of the least significant bit, and to use the other 11 bits as addresses, so that chord establishment can be checked referring to a chord table constituted by addresses having two bits more than those in Table 2.

In the first embodiment, "1" always exists in a bit pattern. After the bit pattern "$00_B$" is checked, a chord table for the remaining ten bits can be referred to in order to check the chord establishment.

As described above, since a chord table is designed to refer to a table for a pattern excluding one bit or more from a 12-bit full pattern, the size of the chord table can be minimized, requiring a smaller memory capacity.

A chord detecting process in the second embodiment will now be explained referring to flowcharts in FIGS. 6A and 6B.

Figure 6A:
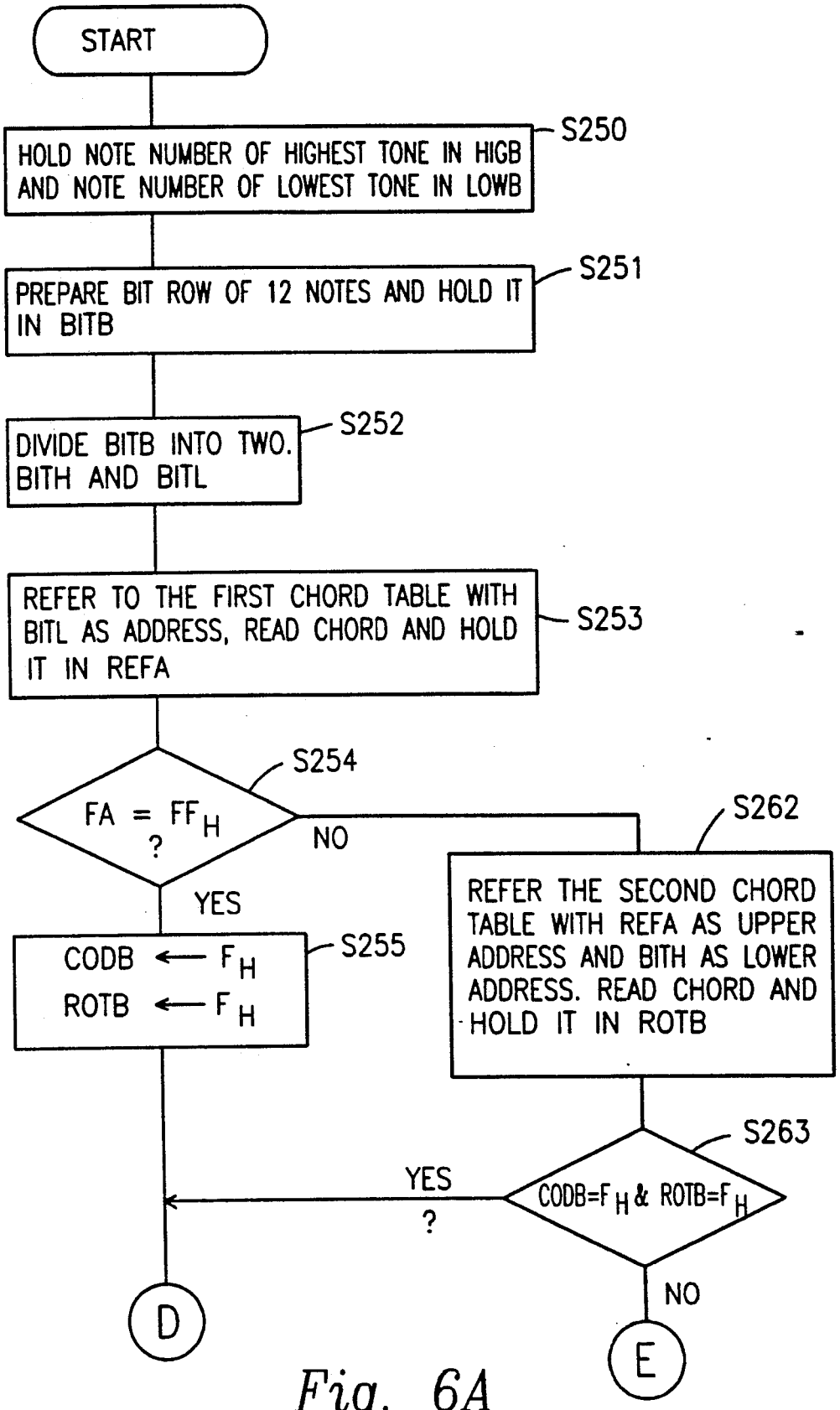
FIGS. 6A and 6B are flowcharts showing a chord detecting process according to a second embodiment.
Figure 6B:
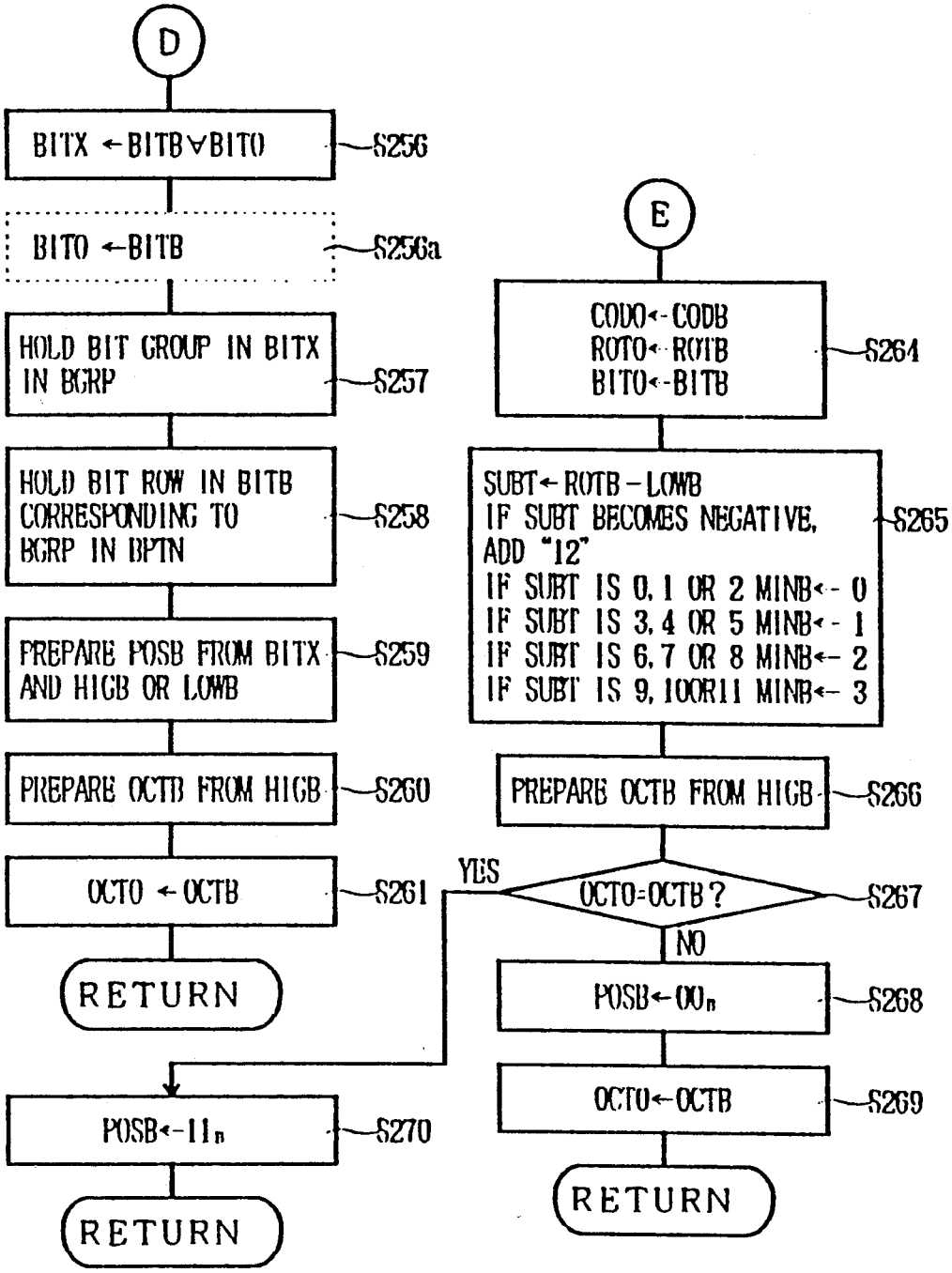

In FIG. 6A, processes in step S250 and S251 are the same as those in step S200 and S201 in the first embodiment. That is, among key numbers in the chord area, the note number of the highest tone and that of the lowest tone are held in the HIGB register and the LOWB register, respectively (step S250). Octave numbers are also held at the same time in the HIGB register and the LOWB register.

The inclusive-or operation is performed on data about the ON/OFF states of the keys in the chord area for every octave, and the result is held as a row of bits in the BITB register (step S251).

The content of the BITB register is divided into two bit blocks; a row of the upper bits is stored in a BITH register and a row of the lower bits is stored in a BITL register (step S252). Examples of the BITH register and BITL register are shown in FIG. 7.

Figures 7, 8:
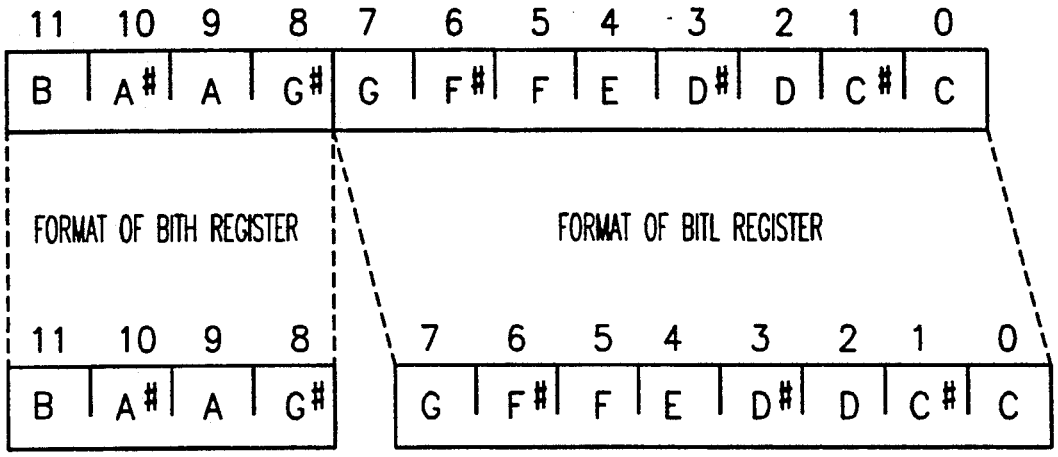
FIG. 7 is a diagram for explaining a split format of a BITB register to be used in the chord detecting process according to the second embodiment.
FIG. 8 is a diagram for explaining another split format example of a BITB register to be used in the chord detecting process according to the second embodiment.

In FIG. 7, the upper four bits of the BITB register are stored in the BITH register and the lower eight bits are stored in the BITL register. A row of bits can however be arbitrarily divided. In other words, the number of bits for each of the BITH register and the BITL register may be arbitrary, and the bits can be arranged as desired. Further, a row of bits may be divided not only into two but also three or more blocks.

Using the content of the BITL register as an address, during reference with the first chord table constituted, for example, as shown in Table 3, associated information is read out and stored in an REFA register (step S253).

According to the first chord table, a head address is stored in a pattern which can be established as a chord by its lower bit row, so that the head address is used to refer to the remaining upper bit row. If a pattern cannot be established as a chord by the lower bit row, "$FF_H$" indicating no chord establishment is stored in the pattern.

TABLE 3

First chord table used in chord detecting process according to the second embodiment

| Address | | | | | | | | Head address of |
|---|---|---|---|---|---|---|---|---|
| G | F# | F | E | D# | D | C# | C | second chord table |
| 0 | 0 | 0 | 0 | 0 | 0 | 0 | 0 | $00_H$ |
| 0 | 0 | 0 | 0 | 0 | 0 | 0 | 1 | $FF_H$ |
| 0 | 0 | 0 | 0 | 0 | 0 | 1 | 0 | $FF_H$ |
| 0 | 0 | 0 | 0 | 0 | 0 | 1 | 1 | $FF_H$ |
| 0 | 0 | 0 | 0 | 0 | 1 | 0 | 0 | $01_H$ |
| ∫ | | | ∫ | | | ∫ | | ∫ |

TABLE 3-continued

First chord table used in chord detecting process according to the second embodiment

| Address | | | | | | | | Head address of |
|---|---|---|---|---|---|---|---|---|
| G | F# | F | E | D# | D | C# | C | second chord table |
| 0 | 0 | 0 | 0 | 1 | 0 | 0 | 1 | $02_H$ |
| ∫ | | | ∫ | | | ∫ | | ∫ |
| 1 | 1 | 1 | 1 | 1 | 1 | 1 | 1 | $FF_H$ |

It is then checked if the head address is "$FF_H$," referring to the content of the REFA register (step S254). When the head address is judged as "$FF_H$," a chord is not established, thereby performing a process in the case of no chord establishment.

First, "$F_H$" is held in both the CODB register and the ROTB register (step S255). "$F_H$" as the content of the CODB register means that a chord is not established though there is a key set ON in the chord area.

The exclusive-or operation is performed on the content of the BITB register and that of the BITO register where a row of bits acquired through the previous chord detecting process is held. The result is stored in the BITX register (step S256). In the exclusive-or operation, the changed bits are stored as "1" in the BITX register.

A process in step S256*a* is then performed, but this step can be skipped. The advantages when this process is to be skipped and not to be skipped are described as in step S211*a* in FIG. 3B.

Figure 9A:
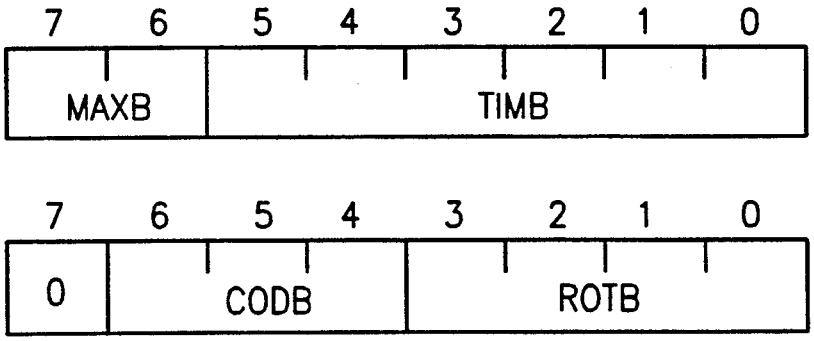
FIGS. 9A and 9B are diagrams for explaining a data format to be used in the chord detecting process according to the second embodiment.
Figure 9B:
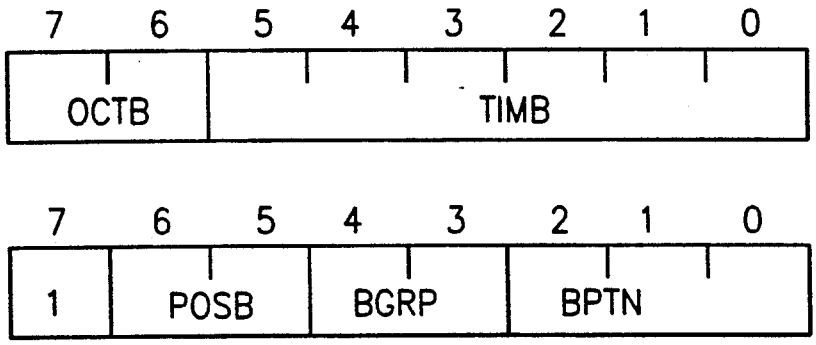

Data is then prepared in a format shown in FIG. 9B. In other words, the number of a group (group number) which a bit set to "1" in the BITX register belongs to is held in a BGRP register (step S257). The BGRP register is defined in the RAM 18.

Data stored in the BGRP register is defined as follows:

(1) BGRP register=$00_B$: D, C#, C
(2) BGRP register=$01_B$: F, E, D#
(3) BGRP register=$10_B$: G#, G, F#
(4) BGRP register=$11_B$: B, A#, A A row of bits corresponding to the group number of the BGRP register is selected in the BITB register, and is stored in the BPTN register (step S258).

A note number $\alpha$ as "1" in the BITX register is compared with the HIGB register and the LOWB register to produce a compensation tone, which is in turn stored in the POSB register (step S259). In other words, it is checked if the content of the BITX register is the same as the contents of the HIGB register and the LOWB register, and data is prepared on the following condition to be stored in the POSB register.

(1) If $\alpha$=HIGB, POSB=$10_B$ (highest tone)
(2) If $\alpha$=LOWB, POSB=$01_B$ (lowest tone)
(3) If $\alpha$ is neither, POSB=$11_B$ (middle tone).

If there is no compensation note, POSB=$00_B$.

An octave number is fetched from the HIGB register, and is stored in the OCTB register (step S260). The content of the OCTB register is then held in the OCTO register (step S261). After the process in step S261 is completed, the flow returns from the chord detecting process routine.

If it is judged in step S254 that the content of the REFA register is not "$FF_H$," data in a format shown in FIG. 9A is prepared. More specifically, if the content of the REFA register is not "$FF_H$," a chord could be established depending on a pattern of the remaining row of bits. Regarding the content of the REFA register as an upper address and the remaining row of bits (the content of the BITH register) as a lower address, associated data is read out referring to the second chord table as shown in Table 4.

TABLE 4

Second chord table used in a chord detecting process according to the second embodiment

| Address | | | | | Contents | |
|---|---|---|---|---|---|---|
| Head address | B | A# | A | G# | 7 6 5 4 Chord type | 3 2 1 0 Chord root |
| $00_H$ | 0 | 0 | 0 | 0 | F (unestablished) | F (unestablished) |
| | 0 | 0 | 0 | 1 | F (unestablished) | F (unestablished) |
| | | | ∫ | | ∫ | ∫ |
| | 1 | 1 | 1 | 1 | F (unestablished) | F (unestablished) |
| $01_H$ | 0 | 0 | 0 | 0 | F (unestablished) | F (unestablished) |
| | 0 | 0 | 0 | 1 | F (unestablished) | F (unestablished) |
| | | | ∫ | | ∫ | ∫ |
| | 1 | 0 | 1 | 0 | 4 (minor7th) | B (B) |
| | | | ∫ | | ∫ | ∫ |
| | 1 | 1 | 1 | 1 | F (unestablished) | F (unestablished) |
| $02_H$ | 0 | 0 | 0 | 0 | F (unestablished) | F (unestablished) |
| | | | ∫ | | ∫ | ∫ |
| | 0 | 1 | 0 | 0 | 4 (minor7th) | 0 (C) |
| | | | ∫ | | ∫ | ∫ |
| | 1 | 1 | 1 | 1 | F (unestablished) | F (unestablished) |

The upper four bits (chord type) of read data are held in the CODB register, and the lower four bits (chord root) are held in the ROTB register (step S262).

It is then checked whether or not the contents of the CODB register and the ROTB register are both "$F_H$" step S263), i.e., if a chord is not established.

When the contents of both registers are judged as "$F_H$," it is acknowledged that a chord is not established, and the flow branches to step S256. The subsequent processes from step S256 are already described above, and their explanation will not be repeated.

When it is judged in step S263 that the content of the CODB register or that of the ROTB register is not "$F_H$," the contents of the CODB register, the ROTB register, and the BITB register are respectively stored in the CODO register, the ROTO register and the BITO register (step S264).

Then, a process is performed to represent the note of the lowest tone from the keys set ON in the chord area by the small number of bits (two bits), i.e., to detect a difference between a chord root (content of the ROTB register) and the lowest tone (content of the LOWB register)(step S265). This process is the same as that in step S222 in the chord detecting process according to the first embodiment, and will not be explained here.

The octave number stored in the HIGB register is held in the OCTB register (step S266).

By comparing the content of the OCTO register with that of the OCTB register, it is checked if a currently obtained octave number is changed from the octave number acquired through the previous chord detecting process (step S267).

If the octave number is judged to be unchanged, the flow branches to step S270 where the content of the POSB register is set to "$11_B$" indicating no octave alternation. The flow then returns from the chord detecting routine. In this case, the value of the POSB register particularly indicates no octave change, though it usually indicates a middle tone.

When the octave number is judged to be changed in step S267, the content of the POSB register is set to "$00_B$" (step S268). This means that the octave is altered but no compensation note is present.

The content of the OCTB register is stored in the OCTO register (step S269), and then the flow returns from the chord detecting routine.

In the above-described chord detecting process in the second embodiment, a row of 12 bits is divided into the upper four bits and the lower eight bits, which are first referred to. Division of bits is not limited to this particular division.

FIG. 8 shows another example of dividing a row of bits. Further, when the chord table is to be referred to, it is arbitrary which register should be first to be used, the BITH register or the BITL register.

The number of divided bits is not limited to two, and it may be three, such as BITH, BITM and TITL, and can be divided into more groups.

As described above, since only bit pattern groups of all the bit patterns of $2^{12}$ where a chord can be established are prepared as a table, and referring to this table by multiple times, the size of the chord table can be minimized, requiring a smaller memory capacity.

Figure 10:
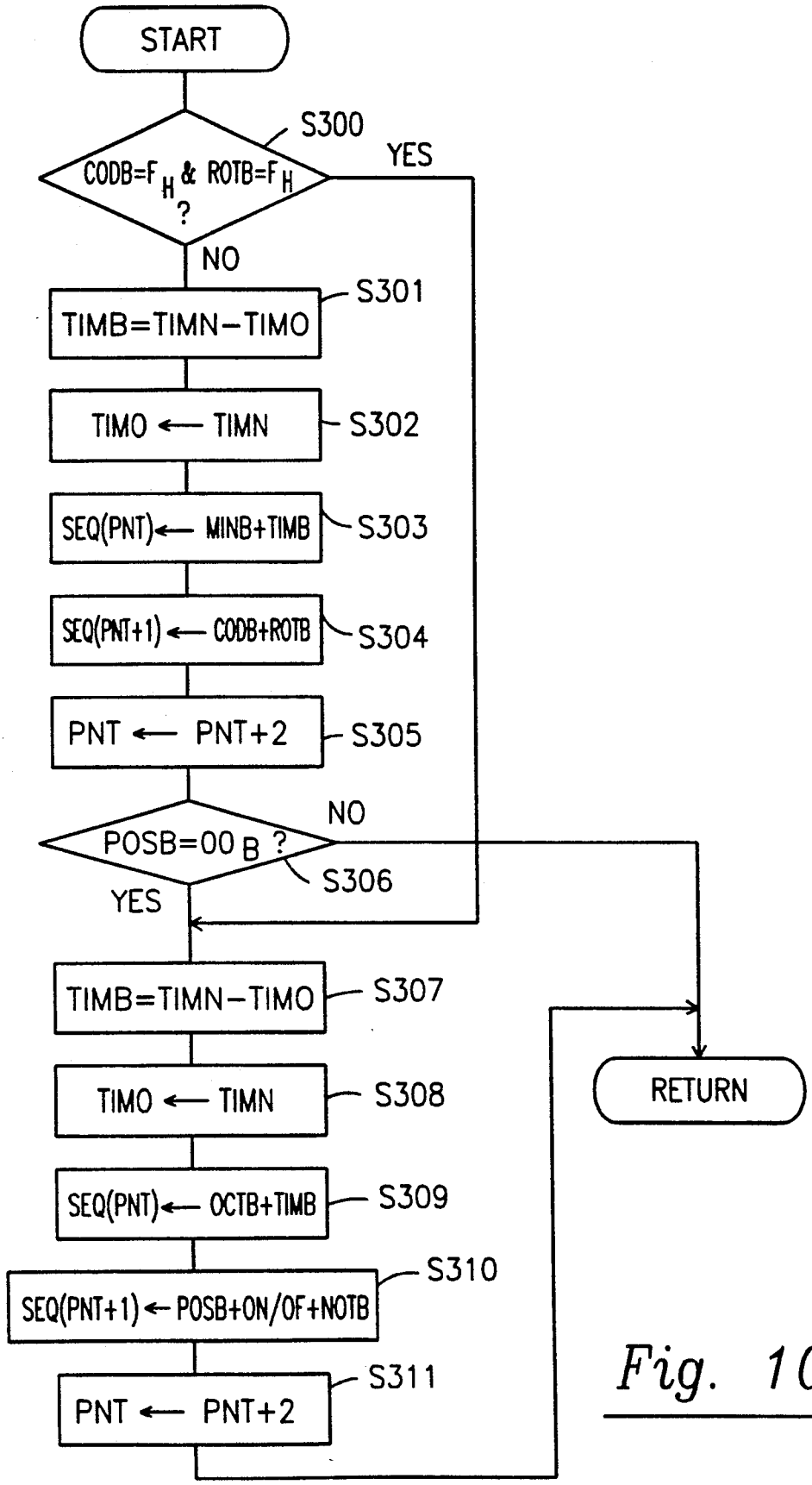
FIG. 10 is a flowchart showing an REC process according to the first embodiment.

The detailed explanation of the REC process in step S114 in the main routine (FIG. 20) according to the first embodiment will now be given referring to a flowchart in FIG. 10.

This REC process in the first embodiment is described in correspondence with the chord detecting process in the first embodiment. A REC process in the second embodiment can be accomplished in almost the same manner.

It is first checked if the contents of the CODB register and the ROTB register are both "$F_H$," i.e., if a chord is unestablished (step S300).

When a chord is judged to be unestablished, the flow branches to step S307. When a chord is judged to be established, however, a difference between a previously changed time (TIMO) and a current time (TIMN) is acquired, and is stored in a TIMB register (step S301). The current time TIMN is held in the TIMO register (step S302).

Then, as shown in FIG. 5A, the contents of the MINB register and the TIMB register are stored at an address indicated by the sequence pointer PNT (step S303). The contents of the CODB register and the ROTB register are stored in an address indicated by the sequence pointer PNT+1 (step S304). Then the sequence pointer PNT is incremented by "2" (step S305).

It is checked whether or not the content of the POSB register is "$00_B$," i.e., if an octave number is to be updated (step S306). If it is judged that the octave number is not updated, the flow returns from the REC process routine.

When the octave number is judged to be updated (the same shall be applied to the case where no chord is established), a difference between the previously changed time (TIMO) and the current time (TIMN) is acquired and is stored in the TIMB register (step S307). The current time TIMN is then held in the TIMO register (step S308).

Then, as shown in FIG. 5B, the contents of the OCTB register and the TIMB register are stored at an address indicated by the sequence pointer PNT (step S309). The contents of the POSB register, the ON/OFF register and the NOTB register are stored in an address incremented by "1" from the address indicated by the sequence pointer PNT (step S310). Then the sequence pointer PNT is incremented by "2" (step S311). The flow returns to the REC process routine. The REC process is then terminated.

Figure 11A:
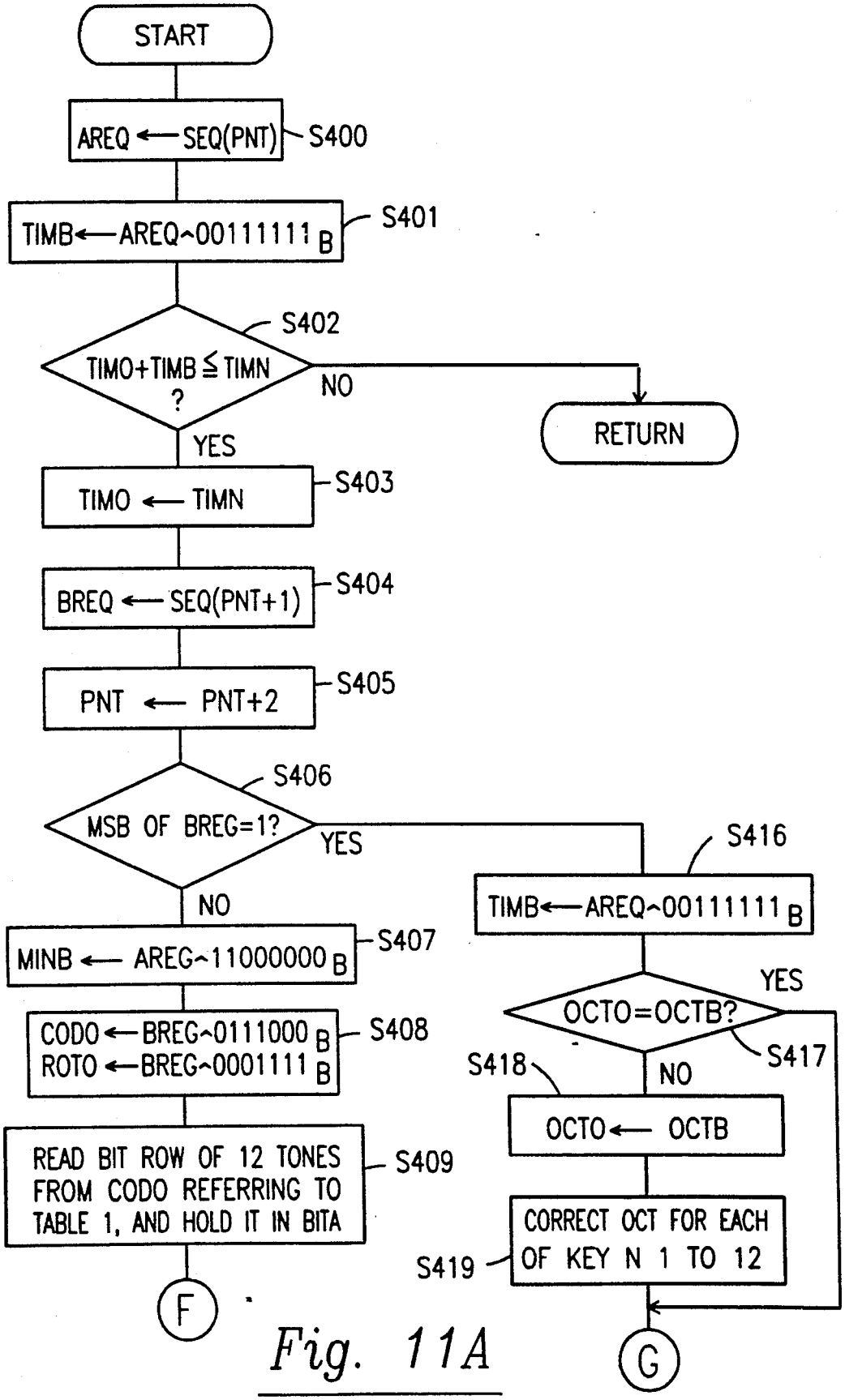
FIGS. 11A and 11B are flowcharts showing a PLY process in the first and second embodiments.
Figure 11B:
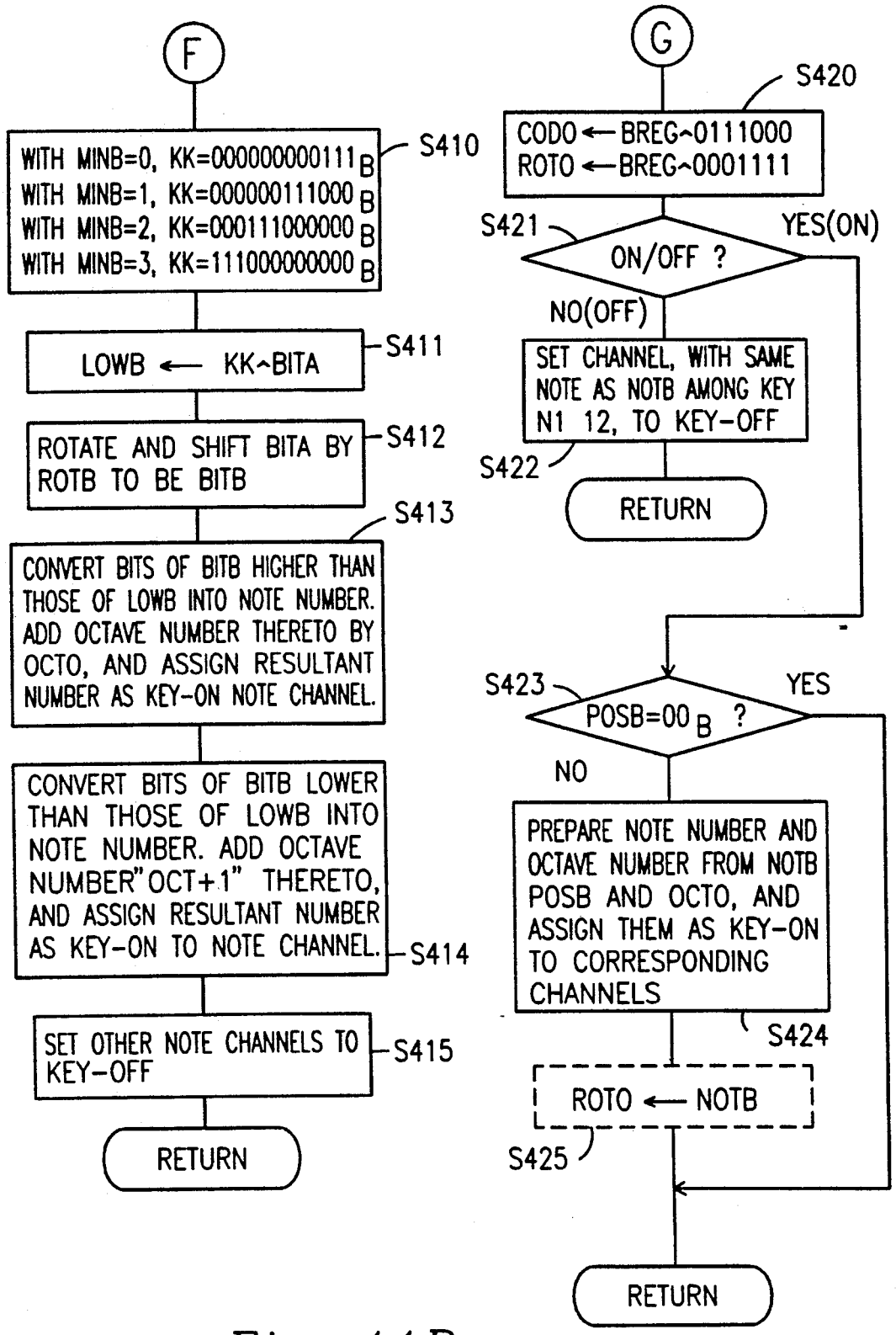

The detailed explanation of the PLY process in step S117 in the main routine (FIG. 2) will now be given referring to flowcharts in FIGS. 11A and 11B.

The PLY process routine is described in correspondence with the chord detecting process according to the first embodiment. A PLY process according to the second embodiment will be accomplished in almost the same manner.

First, data currently indicated by the sequence pointer PNT is read from a sequence memory in the RAM 18, and is held in an AREG register (step S400).

The lower six bits of the AREG register are extracted, and are held in the TIMB register (step S401). Then, the content of the TIMB register obtained in the preceding process is added to a timing register (TIMO) at which the PLY process routine is previously accessed, and the resultant value is checked to be equal to or smaller than a current timing (TIMN)(step S402).

When the current timing (TIMN) is judged to be smaller than "TIMO+TIMB," it is too early to read out new sequence data. The flow therefore returns to the PLY process routine without performing the following processes.

When it is judged that the current timing (TIMN) is equal to or greater than "TIMO+TIMB," new sequence data has to be read out. The flow therefore advances to step S403.

The content of the TIMO register is updated by storing the content of the TIMN register in the TIMO register (step S403). Data is read out at the address indicated by the sequence pointer PNT+1, and is stored in a BREG register (step S404). The content of the sequence pointer PNT is incremented by "2." (step S405).

It is then checked whether or not an MSB of the BREG register is "1" (step S406). In other words, it is checked whether the contents of the AREG register and the BREG register are chord information when a chord is established or an octave number and compensation note information when a chord is unestablished.

When the MSB is judged to be "0," the contents of the AREG register and the BREG register are considered to be chord information when a chord shown in FIG. 5A is established, thereby performing the following processes.

The upper two bits of the AREG register are extracted and then stored in the MINB register (step S407). Information about the lowest tone is therefore held in the MINB register.

Then, three bits down from the second most significant bit of the BREG register are extracted and held in the CODO register, and the lower four bits of the BREG register are extracted and held in the ROTO register (step S408).

Then, a row of 12 tone bits is read out referring to a C standard chord table in Table 1 in association with a chord type stored in the CODO register, and is held in the BITA register (step S409).

The lowest tone of the BITA register is then detected from the value of the MINB register (steps S410 and S411). More specifically, when the content of the MINB register is "$00_B$," a pattern with the lower three bits as "1" is generated. If the content of the MINB register is "$01_B$," a pattern with the following three bits as "1" is produced. Further, when the MINB register indicates "$10_B$," a produced pattern has the following three bits as "1." With the content of the MINB register as "$11_B$," a generated pattern has the upper three bits as "1." That pattern is stored in a KK register (step S410).

The logical product of the values of the KK register and the BITA register is yielded and held in the LOWB register (step S411). Using a feature wherein there exists only one ON key in each of four blocks "C, C#, D," "D#, E, F", "D#, G, G#" and "A, A#, B" with "C" being as a chord root, information MINB about the lowest tone is stored as a 2-bit code in the MINB register. That is, one of the three keys in each case below is set ON, which indicates the lowest tone:

(1) MINB=$00_B$, "C, C#, D"
(2) MINB=$01_B$, "D#, E, F"
(3) MINB=$10_B$, "F#, G, G#"
(4) MINB=$11_B$, "F#, G, G#"

A difference between the chord root and the lowest tone will be explained. The lowest tones are classified as shown in Table 5 even though the chord type and chord root are the same.

TABLE 5

Exemplified relationship between chord root and the lowest tone

| Key number/ octabe number (*1) | | | Chord type | Chord root | Lowest tone | MINB |
|---|---|---|---|---|---|---|
| $C_2$ | $E_2$ | $G_2$ | Major (1) | C (0) | C (0) | $00_B$ |
| $E_2$ | $G_2$ | $C_3$ | Major (1) | C (0) | E (4) | $01_B$ |
| $G_2$ | $C_3$ | $E_3$ | Major (1) | C (0) | B (7) | $10_B$ |

(*1) Capital alphabets indicate key numbers and subscript numerals indicate octave numbers.

A chord type and a chord root are conventionally used, but the use of the lowest tone is not stable. When a chord is established, the lowest tone is not used in most cases.

According to this embodiment, the lowest tone of a chord can be detected, stored and reproduced, thus exactly reproducing, for example, component tones of a backing or arupejio. The lowest tone can also be used as a bass root of automatic bass playing.

The content of the BITA register is rotated and shifted by the value stored in the ROTB register and the result is stored in the BITB register (step S412). As a result, the same row of 12 bits as in the REC process can be generated.

The bits of the BITB register which are above the bits of the LOWB register are converted into a note number. Then, octave data is added to the note number depending on the content of the OCTO register, and the result is assigned as key-ON data to a note channel (step S413). In other words, since a chord is established in this step, the BITB register usually has 3 to 4 key-ON bits excluding the case of the chord type of "0."

The lowest tone bit of the LOWB register and an ON bit higher than that tone are detected from those key-ON bits to be a chord note. The octave number of the OCTO register is added to the chord note and assigned as key-ON data to a corresponding note channel.

A bit of the BITB register lower than that of the LOWB register is converted into a note number. The value of the OCTO register incremented by "1" is regarded as octave data, and is added to the note number. The resultant value is then stored as key-ON data in an associated note channel (step S414). In this step, a key- ON bit of the BITB register lower than the note of the LOWB register is converted into a note chord. Then, that note chord is added to the octave number acquired by adding "1" to the octave number stored in the OCTO register. The result is assigned as key-ON data to a corresponding note channel.

If, for example,

| | B | A# | A | G# | G | F# | F | E | D# | D | C# | C |
|---|---|---|---|---|---|---|---|---|---|---|---|---|
| BITB = | 0 | 0 | 1 | 0 | 0 | 1 | 0 | 0 | 0 | 0 | 0 | 1 |

CODB = Major (1)
ROTB = 2 (D)
LOWB = F#
OCTB = $01_B$.

a tone of F# has octave number=2 and note number=6, a tone of A has octave number=2 and note number=9, and a tone of D has octave number=3 and note number=2.

The other note channels are set to key-OFF (step S415). That is, note channels with no key-ON data assigned thereto in steps S413 and S414 are cleared, and the flow returns from the PLY process routine. In the case where a chord type is "0," i.e., all keys are OFF, all the 12 note channels are cleared.

When the MSB is judged to be "1" in step S406, the contents of the AREG register and BREG register are information when a chord in FIG. 5B is established, thus performing the following processes.

The upper two bits of the AREG register are extracted and stored in the OCTB register (step S416).

The previous octave number (OCTO) is compared with the current octave number (OCTB)(step S417). If they differ from each other, the current octave number (OCTB) is stored in the OCTO register (step S418). Then, the octave numbers OCTO for all the note channels KYEN 1 to 12 are corrected (step S419).

When the same result is obtained in step S417, the processes in steps S418 and S419 are skipped.

The relative position, the ON/OFF state and the note of a compensation tone are fetched from the BREG register, and are stored in the POSB register, the ON/-OFF register and the NOTB register, respectively (step S420).

It is then checked if the content of the ON/OFF register is "1" (step S421). In other words, it is checked whether the compensation tone is added to a current chord (set ON) or a certain tone is deleted from the current chord. If the content of the ON/OFF register is judged as "0," i.e., a certain tone is judged to be deleted from the current chord, note channels out of the KEYN 1 to 12 whose contents are the same as the content of the NOTB register are set in the key-OFF state (step S422). The flow then returns to the PLY process routine.

If it is judged in step S421 that the content of the ON/OFF register is "1," i.e., a certain note is added to the current chord, it is checked whether the content of the POSB register is "$00_B$" (step S423).

The POSB register is set as follows:

(1) POSB register=$00_B$ . . . no compensation (added) note (2) POSB register=$01_B$ . . . compensation (added) note present (lowest tone)

(3) POSB register=$10_B$ . . . compensation (added) note present (highest tone)

(4) POSB register=$11_B$ . . . compensation (added) note present (middle tone)

When the content of the POSB register is judged to be "$00_B$" in step S423, no compensation note is present, and the flow returns to the PLY process routine.

If the content of the POSB register is not judged to be "$00_B$," a compensation note is present. A note number and an octave number are prepared from the contents of the NOTB register, the POSB register and the OCTO register, and those numbers are assigned as key-ON data to corresponding channels (step S424).

In this process, the note number is obtained from the NOTB register. It is acknowledged by the content of the POSB register that a compensation (added) tone is added to the upper, lower or middle portion of a current chord. Further that compensation tone is regarded as octave information for an associated tone referring to an octave number stored in the OCTO register, and is assigned as key-ON data to corresponding note channel (step S424).

In the process in step S425, the lowest tone can be a chord root by holding the content of the NOTB register in the ROTO register. This process is not always required.

The flow then returns from the PLY process routine to the main routine.

An interrupt process will now be explained. FIGS. 12A to 12D are flowcharts for explaining four interrupt processes executed by the electronic musical instrument in the invention.

Figure 12A:
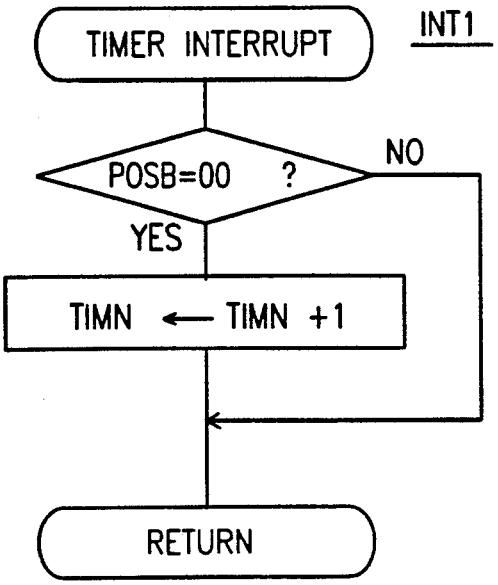
FIGS. 12A to 12D are flowcharts showing an interrupt process according to the individual embodiment of the present invention.

FIG. 12A shows a timer interrupt process. After the timer 15 counts a predetermined value (time), the timer 15 sends an interrupt request signal to the terminal INTI of the CPU 16. The CPU 16 temporarily stops an ongoing process, and executes an interrupt process. First, it is checked if a RUN flag is set to "1." The RUN flag is to set to "1" with the START switch of the panel rendered on. During the operation, therefore, this flag is set to "1."

When the RUN flag is not judged to be "1," i.e., active, the flow returns to the interrupt process routine without performing any processes.

If the RUN flag is judged to be "1," the content of the TIMN register is incremented. As a result, the current time is updated.

Figure 12B:
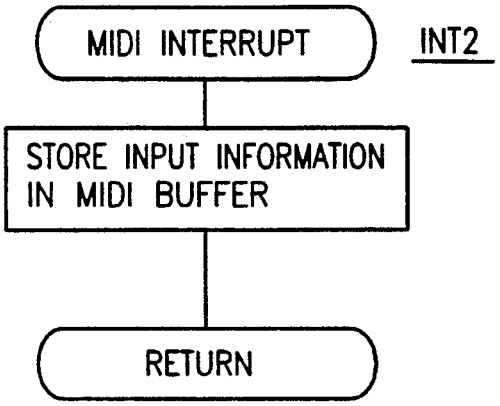

FIG. 12B illustrates a MIDI interrupt process. Upon reception of data from the MIDI IN terminal, the interface circuit 10 sends an interrupt request signal to the terminal INT2 of the CPU 16. The CPU 16 temporarily stops an ongoing process, and processes an interrupt. In this process, the CPU 16 stores information received from the interface circuit 10 to the MIDI buffer of the RAM 18. The flow then returns to the interrupt process routine. As described above, that information stored in the MIDI buffer is used for various processes.

Figure 12C:
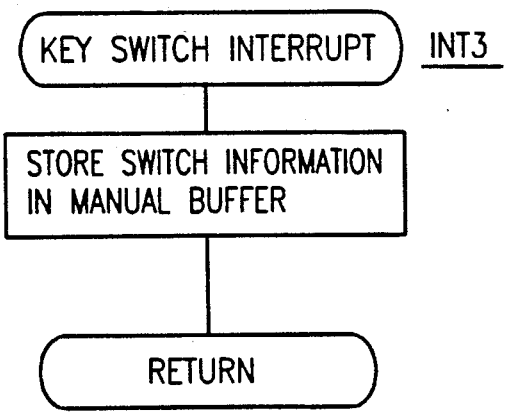

FIG. 12C shows a key switch interrupt process. When the key scan circuit 12 detects that key switch 11 is depressed, the key scan circuit 12 sends an interrupt request signal to the terminal INT3 of the CPU 16. The CPU 16 temporarily stops an ongoing process and processes an interrupt. In the interrupt process, key switch information from the key scan circuit 12 is stored in the manual buffer of the RAM 18. The flow then returns to the interrupt process routine. The information stored in the manual buffer is used for various processes as described above.

Figure 12D:
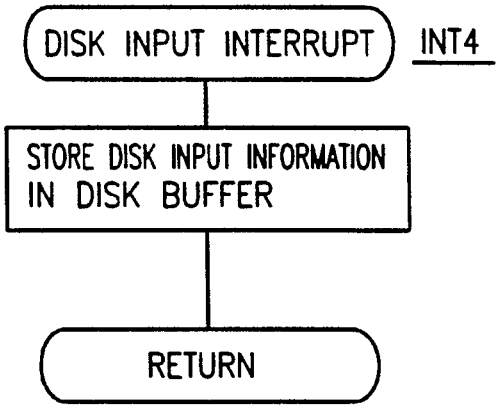

FIG. 12D illustrates a disk input interrupt process. When a data transfer is requested in the disk driver 19, an interrupt request signal is sent to the terminal INT4 of the CPU 16. The CPU 16 temporarily stops an ongoing process and executes an interrupt process. In this process, data supplied from the disk unit 20 through the disk driver 19 is stored in the disk buffer of the RAM 18. The flow then returns from the interrupt process routine. The data stored in the disk buffer is used for various data as described above.

Figure 13:
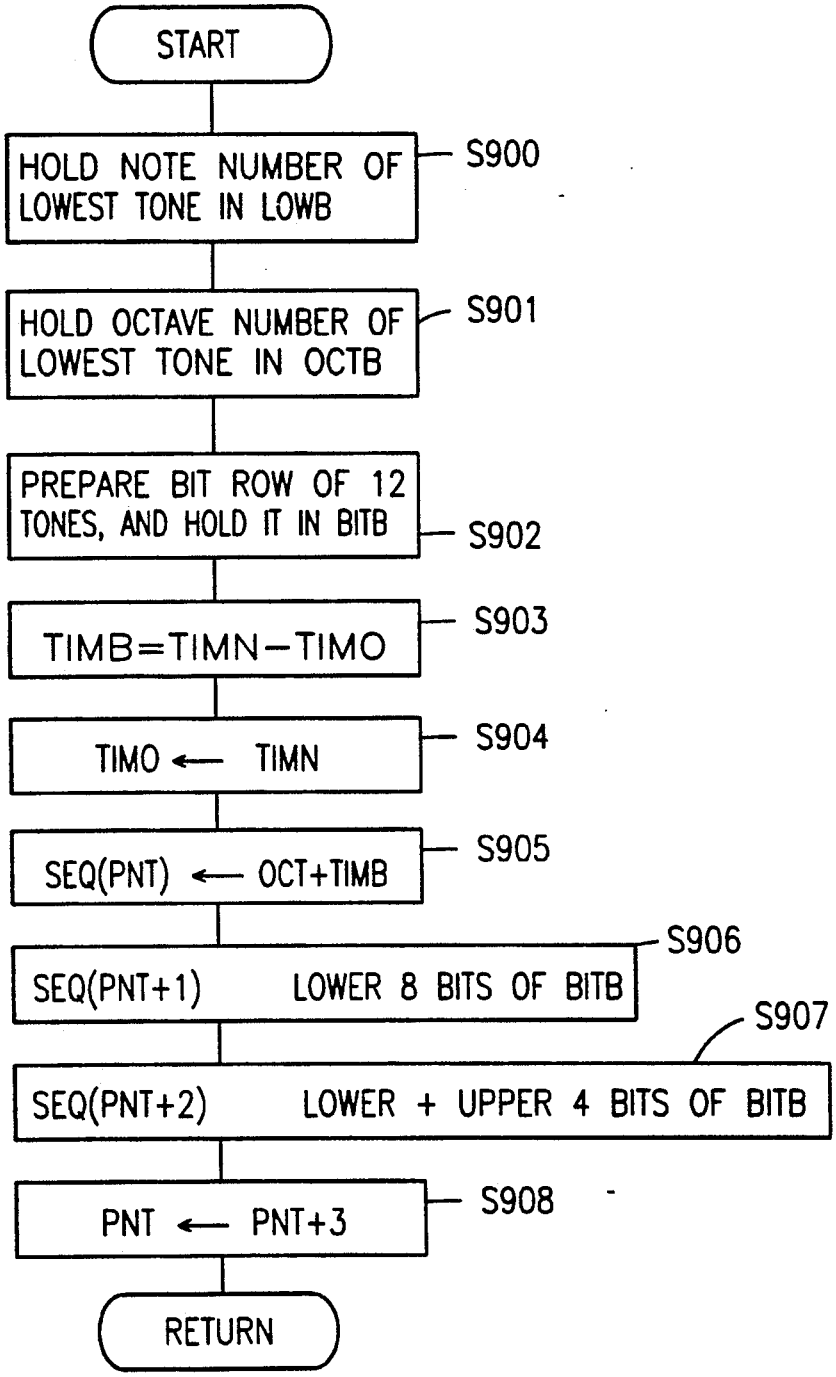
FIG. 13 is a flowchart showing an REC process according to the second embodiment.

An REC process according to the second embodiment will now be explained. FIG. 13 shows a flowchart of the REC process according to the second embodiment.

In this process, a timbre bit map is directly stored without taking the chord detecting routine shown in FIGS. 3A and 3B or FIGS. 6A and 6B. Chord data is stored in a data format shown in FIG. 14.

The note number of the lowest tone among the key numbers in the chord area is stored in the LOWB register (step S900). An octave number is held in the LOWB register at the same time.

The note number of the highest tone is then stored in the OCTB register (step S901). The inclusive-or operation is performed on the ON/OFF state of the key in the chord area for each octave, and the result is stored as a row of bits in the BITB register (step S902).

A difference between the previously changed time (TIMO) and the current time (TIMN) is obtained, and stored in the TIMB register (step S903). The current time (TIMN) is held in the TIMO register (step S904).

Figure 14:
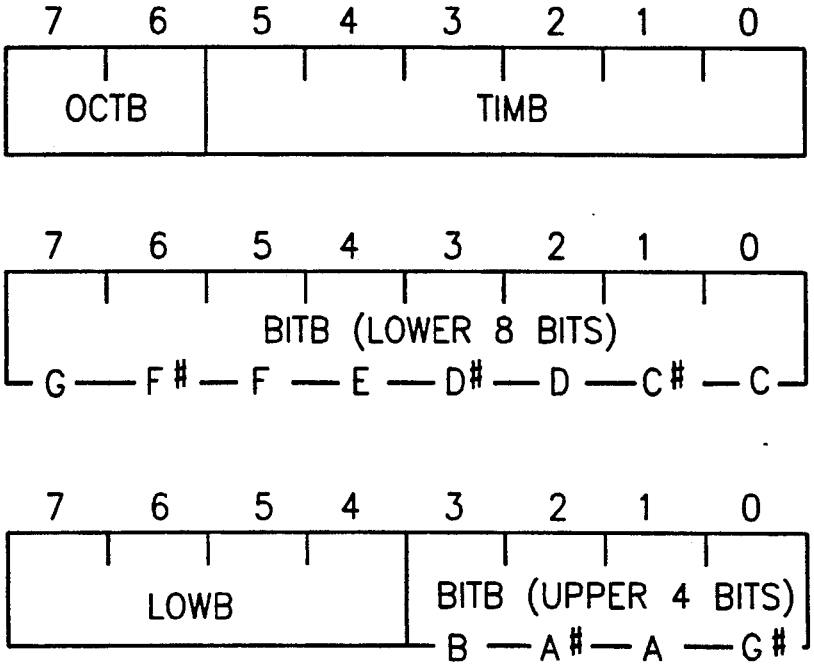
FIG. 14 is a diagram illustrating a data format to be used in the REC process according to the second embodiment.

Then, the content of the OCTB register is linked to that of the TIMB register as shown in FIG. 14, and the linked content is stored at an address indicated by the sequence pointer PNT (step S905). The lower eight bits of the BITB register are stored at an address indicated by the sequence pointer PNT+1 (step S906).

Further, the content of the LOWB register and the upper four bits of the BITB register are linked together, and the resultant content is stored at an address indicated by the sequence pointer PNT+2 (step S907).

The sequence pointer PNT is incremented by "3" (step S908), and the flow returns from the REC process routine.

According to the second embodiment, 3-byte data is always necessary, but data can be stored in the same data format regardless of chord establishment/non-establishment.

Since the note number and octave number of the lowest tone are stored at the same time by a small number of bits as possible, the electronic musical instrument has improved tone reproductivity when it is played.

According to the first and second embodiments, the rotational shifts and comparisons which are difficult for the CPU are reduced so as to quickly perform a chord detecting process, and sizes of a program and a chord table can be minimized, thus requiring a smaller memory capacity of storing the program and chord table.

Specific tone information (highest tone and lowest tone) for a chord, even when established, is stored at a time, thereby reproducing a pattern of component tones which is very close to a pattern when recorded.

Since octave information when changed is stored, accompaniment tones can be reproduced in the range of tones when they are recorded.

If a chord is unestablished, information corresponding to a change in tones of a previous accompaniment pattern is stored as compensation information. It is therefore possible to reduce the amount of information to be stored when a chord is unestablished.

A Major pattern or a particular pattern for no chord establishment is not used in a case where a chord is unestablished. A chord pattern established immediately before is considered as valuable, instead. That pattern is used at least for a chord type, and component tones of a chord are stored after a change from the previous chord pattern is added thereto. This therefore efficiently affects the flow of a performance.

Since the state of no key-ON in the chord area is regarded as a pattern equivalent to a chord, an accompaniment tone is not always added but can be deleted. Accordingly, it is possible to perform a systematic process, thus simplifying the whole operation.

A row of 12 bits is always stored without a chord type and a chord root for chord detection as a standard, and a specific tone information is also stored, thereby easily and exactly reproducing tones.

As described above in detail, according to the present invention, it is possible to provide a chord detecting/storing apparatus which reduces rotate-shift operations and comparison operations difficult for a CPU and thus accelerates a chord detecting process, and which makes programs and chord tables more compact and thereby decrease a their memory storage requirements.

According to the present invention an accompaniment information processing apparatus is provided which adds specific tone information to chord information when a chord is established and stores the information items so as to accurately reproduce the recorded content, and which keeps the flow of an actual accompaniment even when a chord is unestablished and reduces the amount of information to be stored, and which processes recorded chord information at high speed and reproduces the recorded content exactly.

What is claimed is:

1. A chord detecting/storing apparatus, comprising:

designating means for designating musical tones formed by a plurality of notes;

note detecting means for detecting individual notes of the musical tones designated by said designating means;

note extracting means for extracting one of said individual notes detected by said note detecting means;

note bit preparing means for preparing a row of note bits;

said note bit preparing means including means for deleting at least one note bit form said row of note bits;

a chord table for storing chord information to correspond to a pattern of said row of note bits; and control means for searching said chord table using said row of note bits, and reading chord out information to detect a chord.

2. A chord detecting/storing apparatus according to claim 1, further comprising chord root altering means for altering a chord root of chord information read out referring to said chord table based on a note extracted by said note extracting means.

3. A chord detecting/storing apparatus, comprising:

designating means for designating musical tones formed by a plurality of notes;

note detecting means for detecting individual notes of said musical tones;

note bit row preparing and dividing means for preparing and dividing note information detected by said note detecting means into at least two rows of note bits;

a first chord table for storing address information to correspond to patterns of said at least two rows of note bits;

a second chord table for storing chord information to correspond to said patterns in said first chord table;

means enabling said second chord table to acquire said patterns from said first chord table; and control means for referring to said first chord table at least once where said address information is stored by using a predetermined row of note bits prepared and divided by said note bit row preparing and dividing means, means for searching said second chord table for said chord information by using acquired address information and rows of note bits other than said predetermined row, and means for reading out chord information to detect a chord.

4. A chord detecting and accompaniment information processing apparatus, comprising:

designating means for designating musical tones;

component note detecting means for detecting component notes of said musical tones;

chord information generating means for detecting a chord from said component notes and generating chord information including a chord type and a chord root;

specific note information generating means for generating specific note information about said chord information;

storing means for storing said specific note information and said chord information and;

means for correlating said chord information and said specific tone information to one another so that in a detected chord storing process, a preselected component tone is stored together with information concerning chord type and chord root to facilitate retrieval of the stored chord when needed.

5. A chord detecting and accompaniment information process apparatus according to claim 4, wherein said specific note information is a note for designating a lowest note among component notes of a chord.

6. A chord detecting and information processing apparatus according to claim 4, wherein said specific note information is octave information for component notes of a chord.

7. An accompaniment information processing apparatus according to claim 4, wherein said preselected component note is the highest note of said detected component notes.

8. An accompaniment information processing apparatus according to claim 4, wherein said specific note information is a note for designating a highest note among component notes of a chord.

9. An accompaniment information processing apparatus according to claim 4, wherein said specific note information is a key code for designating a lowest note among component notes of a chord.

10. An accompaniment information processing apparatus according to claim 4, wherein said specific note information is a key code for designating a highest note among component notes of a chord.

11. An accompaniment processing apparatus, comprising:

designating means for designating musical tones;

component note detecting means for detecting component notes of said musical tones;

chord/compensation information generating means for generating chord information when a chord is judged to be established by said detected component notes, and for generating compensation information;

said compensation information selectively including chord information and component note information; and storing means for selectively storing said chord information and said component note information.

12. An accompaniment information processing apparatus according to claim 11, wherein said compensation information generated by said chord/compensation information generating means is information about component notes of a chord.

13. An accompaniment information processing apparatus according to claim 8, wherein said compensation information is chord pitch information.

14. An accompaniment information processing apparatus, comprising:

designating means for designating musical tones;

note bit row preparing means for detecting component notes from said musical note and preparing a row of predetermined tone bits;

specific note information generating means for generating specific note information relating to a row of said predetermined note bits; and storing means for correlating a row of said predetermined note bits with said specific note information, and storing said row of said predetermined note bits and said specific note information.

15. An accompaniment information processing apparatus according to claim 14, wherein said specific note information generated by said specific note information generating means is information to designate a lowest note.

16. An accompaniment information processing apparatus according to claim 14, wherein said specific note information is information to designate a highest note.

* * * * *

UNITED STATES PATENT AND TRADEMARK OFFICE

CERTIFICATE OF CORRECTION

PATENT NO. : 5,250,746

DATED : October 5, 1993

INVENTOR(S) : Tsutomu Saito, Taichi Kosungi

It is certified that error appears in the above-indentified patent and that said Letters Patent is hereby corrected as shown below:

Claim 13, Col. 26, Line 34, change "8" to --11--.

Signed and Sealed this

Twenty-eight Day of March, 1995

Bruce Lehman

*Attest:*

BRUCE LEHMAN

*Attesting Officer*

*Commissioner of Patents and Trademarks*